US009587372B2

(12) United States Patent
Benedetti et al.

(10) Patent No.: US 9,587,372 B2
(45) Date of Patent: Mar. 7, 2017

(54) APPARATUS FOR THE DREDGING OF SEDIMENTS FROM THE SEABED

(75) Inventors: Davide Benedetti, Massa (IT); Marco Benedetti, Massa (IT)

(73) Assignee: DECOMAR S.P.A., Pontedera (Pisa) (IT)

( * ) Notice: Subject to any disclaimer, the term of this patent is extended or adjusted under 35 U.S.C. 154(b) by 621 days.

(21) Appl. No.: 13/981,025

(22) PCT Filed: Jan. 23, 2012

(86) PCT No.: PCT/IB2012/000092

§ 371 (c)(1),
(2), (4) Date: Oct. 2, 2013

(87) PCT Pub. No.: WO2012/153169

PCT Pub. Date: Nov. 15, 2012

(65) Prior Publication Data

US 2014/0015302 A1 Jan. 16, 2014

(30) Foreign Application Priority Data

Jan. 21, 2011 (IT) ..... MI2011A000061

(51) Int. Cl.
*E02F 3/92* (2006.01)
*E02F 3/88* (2006.01)
(Continued)

(52) U.S. Cl.
CPC ..... *E02F 3/92* (2013.01); *E02F 3/885* (2013.01); *E02F 3/90* (2013.01); *E02F 3/9243* (2013.01);
(Continued)

(58) Field of Classification Search
CPC ..... E02F 3/9293; E02F 3/88; E02F 3/92
(Continued)

(56) References Cited

U.S. PATENT DOCUMENTS 188,369 A * 3/1877 Hyde ..... E02F 3/925 175/5
396,112 A * 1/1889 Rice ..... E02F 3/925 285/184
(Continued)

FOREIGN PATENT DOCUMENTS

CA 982195 A1 1/1976
DE 1220797 B 7/1966
(Continued)

OTHER PUBLICATIONS

International Search Report dated Jul. 3, 2012 from corresponding International Application No. PCT/IB2012/000092.

*Primary Examiner* — John G Weiss
(74) *Attorney, Agent, or Firm* — Duane Morris LLP

(57) ABSTRACT

A dredging apparatus for removing sediments from a bed of an expanse of water, includes: a suction apparatus including a) a submersible pump including: a housing body provided with an inlet mouth and with a discharge opening and an impeller rotatably supported in the body between the inlet mouth and the discharge opening and rotatably driven by a respective driving device; and b) a suction head associated to the inlet mouth of the housing body of the pump and provided at the bottom with a suction opening of the sediments; wherein the suction opening of the head has a value of the cross-section area dimensioned to achieve in the working range of the pump a suction speed capable of removing the sediments by means of the fluid dynamics removal action carried out by the water sucked into the head.

19 Claims, 7 Drawing Sheets

(51) Int. Cl.

| | |
|---|---|
| ***E02F 3/90*** | (2006.01) |
| ***E02F 5/00*** | (2006.01) |
| ***F04D 7/04*** | (2006.01) |
| ***E02F 5/28*** | (2006.01) |

(52) U.S. Cl.
CPC ..... *E02F 3/9293* (2013.01); *E02F 5/006* (2013.01); *E02F 5/28* (2013.01); *F04D 7/04* (2013.01)

(58) Field of Classification Search
USPC ..... 37/321–323, 317, 318, 335; 299/9
See application file for complete search history.

(56) References Cited

U.S. PATENT DOCUMENTS 782,260 A * 2/1905 Milne ..... A01G 25/097 15/354
952,928 A * 3/1910 McCauley ..... E02F 3/925 37/323
1,719,668 A * 7/1929 McEachern ..... E02F 3/925 37/318
3,152,409 A 10/1964 Ramsden et al.
3,474,549 A * 10/1969 Schnell ..... E02F 3/9231 37/322
3,646,694 A * 3/1972 Beck, Jr. ..... E02F 3/90 299/8
3,783,535 A 1/1974 Hanks
3,910,728 A 10/1975 Sloan
3,975,842 A * 8/1976 Andreae ..... E02F 3/9212 299/9
4,143,921 A 3/1979 Sweeney et al.
4,995,175 A * 2/1991 Winter ..... E02F 3/88 37/308
6,138,833 A * 10/2000 Matsufuji ..... B03B 5/60 209/10

FOREIGN PATENT DOCUMENTS

DE 3303746 A1 * 8/1984 ..... B03B 9/00
DE 102004017201 A1 * 11/2005 ..... E02B 3/023
GB 1076462 A 7/1967
GB 2025484 A * 1/1980 ..... E02F 3/90
GB 2080435 A 2/1982
GB 2457784 A 9/2009
JP S5394430 A 8/1978
JP H02116549 U 9/1990
WO WO 2008/046115 * 4/2008

* cited by examiner

APPARATUS FOR THE DREDGING OF SEDIMENTS FROM THE SEABED

FIELD OF THE INVENTION

The present invention relates to the field of dredging systems for removing sediments from a bed of an expanse of water such as, for example, a sea bed, a river bed, a lake bed, a marsh bed, etc.

The present invention relates, more specifically, to a dredging apparatus for removing sediments from a bed of an expanse of water, as well as to a dredging method which may be carried out by means of the aforementioned apparatus.

RELATED ART

In the field of dredging of sediments from a sea bed, river bed or marsh bed, essentially three types of dredging apparatuses are known: dredging apparatuses making use of pumps (so-called sucking-discharging pumps, screw pumps, vane pumps, diaphragm pumps), dredging apparatuses of the type with grab buckets and so-called bucket dredge apparatuses that use a plurality of cups or buckets moved by chains.

In dredging apparatuses of the first type a pump is generally used the function of which is to supply energy to the water/sediment slurry sucked so as to push it into a discharge (or back flowing) conduit overcoming the losses due to friction and to the effects due to variations in slope.

In order to allow the removal of sediments that would otherwise be very limited, different types of agitating/disgregating devices are used that have the function of disgregate and suspending the sediments, creating a suspension that can be sucked by the pump.

Currently, essentially two types of agitating devices are used: a first of mechanical type and a second of the water jet type.

The first type of agitating devices generally consists of a series of vanes with coatings made of a wear-resistant material, rotated by an extension of the drive shaft of the impeller of the pump or by means of auxiliary motors directly positioned close to the inlet mouth of the pump itself when it is necessary to operate at particularly low rotation speeds.

The second type of agitating devices, on the other hand, uses a series of nozzles arranged close to the inlet mouth of the pump that direct pressurised water towards the water bed, achieving a disgregating effect, bringing the sediments into suspension and carrying out a pre-mixing thanks to the turbulence generated.

Dredging apparatuses of the so-called grab bucket type, on the other hand, comprise one or more buckets formed from two opposite centrally-hinged buckets, which rest on the bottom in an open position and which allow sediments to be withdrawn from the water bed.

The operating principle of these dredging apparatuses is the following: on the surface, the buckets are kept open with a hook, and are then lowered at a constant low speed.

The buckets are equipped with holes that allow the air to come out during immersion. Once the bottom is touched, the holding hook is disengaged and, while lifting, the buckets grip the sediment thanks to a lever linkage system. The amount of withdrawn material depends on the compactness of the bottom and on the size and weight of the buckets.

Dredging apparatuses of the so-called bucket dredge type, on the other hand, comprise a plurality of cups or buckets fixed to a chain that, sliding on a guide pivoted on the craft and suitably inclined to rest on the bottom, allow the sediments to be withdrawn from the water bed.

SUMMARY OF THE INVENTION

The Applicant has found that the aforementioned known dredging apparatuses which make use of pumps have a series of drawbacks for which an adequate solution has not yet been found.

A first drawback is essentially related to the fact that the agitating/disgregating devices that are used allow to operate with a content of solid material in the water/sediment mixture which does not normally exceed 20-25 volume % (normally equivalent to 40-45% by weight) and in any case with decreasing efficiency as the dredging depth increases.

The need to suspend the sediments implies in turn a low efficiency of the dredging apparatus, i.e. the need to move very high flow rates of water to achieve the removal of the sediments, with undesired additional negative consequences in terms of size of the pump, of its driving motor, of the discharge ducts, and therefore with inevitable negative consequences in terms of time and cost of the dredging operations.

A second serious drawback is essentially related to the fact that the agitating/disgregating devices which are used generate a water turbidity which makes dredging apparatuses of the so-called sucking-discharging type unable to be used in dredging sites of the SCI type (Site of Community Importance), SNI type (Site of National Importance) or in any case in areas where for environmental reasons it is not permitted to create any kind of water turbidity and/or any dispersion of polluting sediments in the water.

In the aforementioned areas, in fact, the absence of turbidity is one of the operating parameters that is generally imposed in order to avoid a possible imbalance of the environmental system (fauna and flora) with consequent environmental damage or to avoid the dispersion of sedimented polluting materials which would be dispersed again by the disgregating action of the agitating/disgregating devices with totally harmful effects on the environment and on the health of flora and fauna.

More specifically, the dredging methods in SNI areas according to current standards must be such as to minimise the impact on the surrounding environment and achieve the following objectives:

- to dredge safely and accurately, minimising the amount of water present in the removed materials;
- to make the amount of dispersed material proximal to zero or in any case minimal, adopting closed systems where possible; and
- to limit the turbidity and the dispersion of pollutants caused by the dredging operations.

It is evident, however, that these objectives cannot be achieved by any dredging apparatus provided with agitating/disgregating devices.

A third drawback is essentially related to the fact that the mechanical disgregating action carried out by such known dredging apparatuses does not allow the latter to operate safely in the presence of cables, chains or other bulky debris: consequently, these apparatuses cannot be used in ports or rivers used for nautical activity or in areas where the presence of remnant explosive devices may be possible without first performing a clearance sweep, which implies an additional penalisation in terms of time and cost of the dredging operations.

The Applicant has also found that although the dredging apparatuses of the grab bucket type have simplicity of operation that makes them suitable for carrying out dredging in SNI sites, these dredging apparatuses also have a series of drawbacks that still limit their performance. In particular, dredging apparatuses of the grab bucket type have:

- a low positioning precision and a low capacity of withdrawing the sediments;
- a low ability to render proximal to zero or in any case minimal the amounts of material dispersed during the steps of loading and moving the withdrawn sediments;
- a low ability to limit the water turbidity during the operating steps, generating ascent turbulence;
- a low production capacity;
- a poor operating safety in the absence of a prior clearance sweep of remnant explosive devices; and
- a poor or limited operability on water beds contaminated by the presence of foreign bodies (like chains, logs, ropes, anchors, or other bulky material).

The Applicant has thus perceived the possibility of at least partially overcoming the aforementioned drawbacks and, more specifically, the possibility of providing a dredging apparatus for removing sediments from a bed of an expanse of water that can be used without any kind of limitations also in SCI or SNI sites or in any case in areas where for environmental reasons it is not permitted to have any water turbidity, by intervening on the fluid-dynamic characteristics of the dredging operations, in particular by creating an adequate depression upstream of the suction pump capable of determining the suction of an amount of liquid capable of carrying out an effective removal action of the sediments without any intervention of "active" disgregating devices of the mechanical or nozzle type.

More specifically, according to a first aspect, the present invention relates to a dredging apparatus for removing sediments from a bed of an expanse of water, comprising a suction apparatus including:

a) a submersible pump including:

a1) a housing body provided with an inlet mouth and with a discharge opening;

a2) an impeller rotatably supported in said body between said inlet mouth and said discharge opening and rotatably driven by a respective driving device;

b) a suction head associated to said inlet mouth of the housing body of the pump and provided at the bottom with a suction opening of the sediments;

wherein the suction opening of the head has a value of the cross-section area dimensioned to achieve in the working range of the pump a suction speed capable of removing the sediments by means of the fluid dynamics removal action carried out by the water sucked into said head.

In accordance with a second aspect thereof, the present invention relates to a dredging method for removing sediments from a bed of an expanse of water, comprising:

a) positioning, close to the bed, a suction apparatus including:

- a submersible pump including:
- a housing body provided with an inlet mouth and with a discharge opening of the water;
- an impeller rotatably supported in said body between said inlet mouth and said discharge opening and rotatably driven by a respective driving device; and a suction head associated to said inlet mouth of the housing body of the pump and provided at the bottom with a suction opening of the sediments provided with a longitudinal axis substantially vertically oriented in use;

b) operating the submersible pump so as to achieve, in the working range of the pump a suction speed capable of removing the sediments by means of the fluid dynamics removal action carried out by the water sucked into said head.

In the following description and in the subsequent claims, the term "sediments", will be used to indicate any type of solid or semi-solid substance deposited by gravity on the bed of an expanse of water, such as for example sand, gravel, mud, slimes and debris.

In the following description and in the subsequent claims, the term "expanse of water", should be interpreted in its widest sense including not only substantially confined water such as lakes, ports, watersheds, marshes, etc., but also open or free-running water such as seas and rivers.

In the following description and in the subsequent claims, the term "submersible pump", will be used to indicate a pump provided with an impeller and with a respective water-tight driving device, both immersed in the expanse of water in which it is necessary to carry out the dredging operations, or in any case any pump capable of generating a depression inside the head such as of the type with a pulsed flow, for example peristaltic, a piston pump and a membrane pump.

In the following description and in the subsequent claims, the term "impeller", will be used to indicate any type of bladed wheel which allows to transform the energy supplied by the driving device of the pump into kinetic energy. Thus, for example, the impeller can be provided with a series of shaped blades radially arranged on a disc-shaped body (in which case, the pump is of the centrifugal type), or it can be provided with a series of blades radially extending from a hub (in which case, the pump is of the axial type), or it can be shaped like lobes or like a worm screw.

In the following description and in the subsequent claims, the term "driving device", will be used to indicate any apparatus, such as for example a hydraulic or electric motor, or any kinematic motion transmission mechanism capable of rotating the impeller of the pump at the desired speed.

In the following description and in the subsequent claims, the term "working range of the pump", will be used to indicate, for a pump of given size and power, the combination of flow rate and head which allows the pump to carry out the dredging operations.

Within the framework of the present description and in the subsequent claims, the parameter "suction speed", is meant to be measured at the suction opening of the suction head or immediately upstream thereof. This parameter should also be understood to refer both to the water as such and to a slurry of water and sediments as a function of the operating conditions of the dredging apparatus.

Within the framework of the present description and in the subsequent claims, the parameter "speed of the liquid phase recirculated towards the suction opening" is meant to be measured at the suction opening of the suction head or immediately upstream thereof.

Within the framework of the present description and in the subsequent claims, all numbers expressing amounts, quantities, percentages, and so forth, are to be understood as being preceded in all instances by the term "about" except where otherwise indicated. Also, all ranges of numerical entities include all the possible combinations of the maximum and minimum numerical values and all the possible intermediate ranges therein, in addition to those specifically indicated hereinbelow.

In the following description and in the subsequent claims, finally, the terms "horizontal", "vertical", "upper", "lower"

and "lateral" will be used to indicate geometric and structural elements of the dredging apparatus and of the components which constitute the same as oriented in the use condition thereof.

In accordance with the invention and thanks to the presence of:

- a submersible pump including an impeller and a respective driving device that can be both immersed in the expanse of water during the dredging operations, and
- a suction head having a suction opening of the sediments with a suitably dimensioned cross-section area, it is advantageously possible both to bring the suction head of the sediments as close as possible to the bed, and to greatly increase the suction speed in the working range of the pump without having cavitation phenomena and at the same time generating a strong depression at the suction opening and immediately upstream thereof such as to draw from the outer perimeter of the suction opening of the head both water and sediments that are thus eroded—without any appreciable dispersion—by means of the effect of just the fluid dynamics removal action carried out by the water sucked in the head.

In other words and differently from the dredging apparatuses of the known so-called sucking-discharging type, the dredging apparatus of the invention lacks agitating/disgregating devices (be they of the mechanical type or using a water jet), or parts or devices having the function of disgregating and bringing in suspension the sediments thereby creating a suspension that can in some way disperse in water and be no longer sucked by the fluid dynamics removal action carried out by the water sucked in the head.

In sharp contrast, the dredging apparatus and method of the invention allow to effectively carry out the dredging operations in the absence of any contact with the water bed by means of a fluid-dynamic suction/removal action of the sediments carried out by the water sucked by the suction head by means consequent to the depression generated both at the suction opening of the head and close to said suction opening, in particular beneath and around the same.

The dredging apparatus and method of the invention are therefore capable to overcome all the drawbacks of the known dredging apparatuses, both of the sucking-discharging type and of the grab bucket type or of the bucket dredge type, as well as of dredging methods carried out by means of the same.

In particular, the dredging apparatus and method of the invention allow to:

- suck a water/sediment slurry having a high solid content, until a value equal to or greater than 40% by volume is reached and, therefore, to achieve a high dredging efficiency in terms of productivity;
- drastically reduce the environmental impact, allowing their use in SCI or SNI sites or in any case in areas where for environmental reasons water turbidity and/or dispersion of polluting sediments in water is not admissible;
- recover and, if needed, treat and/or exploit, the dredged solid materials;
- reduce the time and cost of interventions.

The present invention in at least one of the aforementioned aspects can have at least one of the preferred features which follow.

Dredging Apparatus

For the purposes of the invention, the suction opening of the suction head is preferably shaped such as to allow the passage of the desired suction flow rate in the working range of the pump at the aforementioned speed adapted to remove the sediments by means of the fluid dynamics removal action carried out by the water sucked in the head.

The suction opening of the head can thus be circular, elliptical, polygonal, or of another type according to the dredging operations that are to be carried out.

Preferably, the suction opening of the suction head is circular or polygonal for obvious reasons of simplicity of construction.

Preferably, the minimum size (minimum diameter in the case of a circular suction opening) is 100 mm, whereas the maximum size (maximum diameter in the case of a circular suction opening) is 1500 mm More preferably, the size (diameter in the case of a circular suction opening) of the suction opening is comprised between 200 mm and 1200 mm and, still more preferably, between 300 mm and 900 mm.

Preferably, the cross-section area of the suction opening is comprised between 0.008 and 1.76 $m^2$. More preferably, the cross-section area of the suction opening is comprised between 0.03 and 1.13 $m^2$ and, still more preferably, between 0.07 and 0.63 $m^2$.

In this way, it is advantageously possible to impart optimal values to the size of the suction opening according to the physical and cohesion characteristics of the sediments to be drawn.

By operating within the aforementioned preferred size values of the suction opening and as a function of the flow rate of the submersible pump (the value of which can be determined at the design stage), moreover, it is advantageously possible to generate a strong depression that determines the suction of a water/sediment slurry having a solid concentration that may be very high.

In a preferred embodiment, the suction opening of the head has a cross-section area smaller than the maximum cross-section area of the suction head.

In this way, it is advantageously possible to create, within the suction head, a calibrated section which generates a strong depression both at the suction opening of the head and close to said suction opening with a consequent high suction speed of the water or of the water/sediment slurry.

Preferably and as will become clearer hereafter, the average suction speed, measured at the suction opening of the suction head, can vary between 0.3 m/s and 30 m/s essentially as a function of the particle size and of the cohesion characteristics of the sediments.

More specifically, the average suction speed is a function of the following parameters:

- particle size and cohesion characteristics of the material to be sucked;
- degree of contamination by foreign bodies and size thereof;
- suction depth; and
- percentage of solids in the water/sediment slurry to be obtained.

Moreover, it is advantageously possible, thanks to the increase of the cross-section area downstream of the suction opening, to achieve an adequate reduction in the average speed of the water/sediment slurry sucked into the head so as to allow an adequate slowing of the solid material (sediments but also broken stone, or debris of various kinds) sucked up.

Preferably, the average speed at the maximum cross-section area of the suction head is comprised between 0.1 m/s and 25 m/s.

As a consequence of such average suction speeds, the absolute pressure value at the inlet mouth of the housing body of the pump is preferably kept at values not lower than 0.1 bar so as not to trigger undesired cavitation phenomena.

Clearly and as a function of the dredging depth, i.e. of the value of the liquid head which lies above the suction head and the pump associated thereto, it is possible to have a depression within the suction head and in particular at the inlet mouth of the housing body of the pump even with absolute pressure values greater than 1 bar for example when the dredging operations are carried out at depths higher than 10 m.

In this case, the liquid head further facilitates the dredging operations carried out by means of the apparatus and the method of the invention since the liquid head makes it possible, if wished, to increase the suction speed without significantly approaching the cavitation conditions of the pump.

For the purposes of the invention, the suction head can have a variety of different shapes.

In a preferred embodiment and irrespective of the specific shape of the suction head, the latter comprises a perforated partition supported in the head downstream of the suction opening and adapted to hold solid material having a size exceeding the passing section of the holes made in the perforated partition.

Preferably, the perforated partition is mounted stationary within the suction head.

For the purposes of the invention, the shape, size, distribution and number of holes can be selected by a man skilled in the art according to the particle size characteristics of the sediments to be sucked so as to optimise the efficiency of the subsequent steps of separating and decontamination of the solid material sucked up.

Thus, for example, the shape of the holes made in the perforated partition can be circular, elliptical or polygonal according to the particle size characteristics of the sediments.

Preferably, the holes made in the perforated partition are uniformly distributed in the part of the partition exposed to the passage of the water/sediment slurry.

Preferably, the minimum size (minimum diameter in the case of circular holes) of the holes is 15 mm, whereas the maximum size (maximum diameter in the case of circular holes) is 300 mm.

Preferably, the holes made in the perforated partition are circular and have a cross-section passage area comprised between 175 and 75000 $mm^2$.

Advantageously, the positioning of the perforated partition within the suction head allows to obtain, with respect to the known dredging apparatuses, not only a greater operating flexibility of the dredging apparatus since any large solid residues are no longer capable to interfere with the operation of the suction head, but also the possibility of separating the solid material having a size exceeding the passage section of the holes made in the perforated partition from the rest of the sediments, holding such material in the area of the head upstream of the perforated partition for subsequent recovery and removal.

In other words, the perforated partition advantageously carries out the function of a classifying partition which carries out a first particle size selection of the sediments sucked by the suction head.

The depression conditions generated within the suction head during the dredging operations, moreover, advantageously allow to hold the coarse solid material separated by the perforated partition within the suction head during the dredging operations and thus allow to recover such material extracting it from the dredged area so as to suitably dispose of the same.

In particular, in the case of dredging in contaminated sites this characteristic allows the suction head to carry out an energetic washing of the sediments of dimensions exceeding the dimensions of the holes of the perforated partition, so as to remove all its polluting impurities and allow the recover or disposal of the sediments at lower costs.

In the case in which a perforated partition is supported in the suction head, the preferred feature according to which the suction opening of the head has a smaller cross-section area than the maximum cross-section area of the suction head, allows to obtain the additional important advantageous technical effects of:

- limiting the mechanical stresses on the perforated partition;
- limiting the wearing phenomena due to impacts on the perforated partition;
- allowing a sufficient autonomy of operation between a cleaning operation of the area upstream of the perforated partition and the next one; and
- carrying out a prior sorting of the sucked sediments so as to optimise the subsequent steps of separation and/or decontamination.

In a preferred embodiment, the suction head can have a cylindrical shape and has a substantially constant cross-section area (thus equal to the maximum cross-section area of the head).

In a further preferred embodiment, the suction head comprises at least a first portion proximal to the suction opening having a progressively increasing cross-section area moving away from said opening and a second portion distal with respect to the suction opening having a substantially constant cross-section area.

In this way, it is advantageously possible both to progressively slow down the speed of the water/sediment slurry sucked into the head, and to facilitate the emptying of the suction head from the debris held upstream of the perforated partition possibly present in the head itself.

In this way, it is thus advantageously possible to optimise from the geometric and fluid-dynamic point of view the area of the suction head proximal to the suction opening (upstream of the perforated partition, if present).

Preferably, the suction head comprises, in the aforementioned first portion proximal to the suction opening, a lower wall having an inclination with respect to a longitudinal axis of the suction opening comprised between 5° and 85° and, still more preferably, between 25° and 70°.

Within the framework of the present description and in the subsequent claims, the angular inclination values are meant to be measured in the clockwise direction starting from the longitudinal axis of the suction opening and considering the parts to the right of such an axis in the vertical use condition of the head.

It is evident that for reasons of symmetry, such angular inclination values are identical to those measured in the anti-clockwise direction starting from the longitudinal axis of the suction opening and considering the parts to the left of such an axis.

In a further preferred embodiment, the suction head comprises a first portion proximal to the suction opening having a substantially constant cross-section area and a second portion distal with respect to the suction opening having a progressively decreasing cross-section area moving away from said first portion.

In this way, it is advantageously possible to optimise from the geometric and fluid-dynamic point of view the area of the suction head distal with respect to the suction opening (downstream of the perforated partition, if present) in particular improving the fluid-dynamic efficiency of the head close to the inlet mouth of the body of the pump, optimising the operation of the latter.

In a further preferred embodiment, the suction head comprises at least a first portion proximal to the suction opening having a progressively increasing cross-section area moving away from said opening and a second portion distal with respect to the suction opening having a progressively decreasing cross-section area moving away from said first portion.

In this way, it is also advantageously possible to optimise from the geometric and fluid-dynamic point of view both the area of the suction head proximal to the suction opening, and the distal one with respect to such an opening (respectively upstream and downstream of the perforated partition, if present).

Preferably, the suction head comprises, in the aforementioned second portion distal with respect to the suction opening, an upper wall having an inclination with respect to a longitudinal axis of the suction opening comprised between 95° and 175° and, still more preferably, between 120° and 150°.

In a preferred embodiment, the suction head comprises a pair of portions proximal to the suction opening having a progressively increasing cross-section area moving away from said opening and a different inclination with respect to the longitudinal axis of the suction opening.

More specifically, the suction head preferably comprises a first portion of its lower wall closer with respect to the suction opening having an inclination with respect to the longitudinal axis of the suction opening comprised between 0° and 85° and, still more preferably, between 5° and 70° and a second portion of its lower wall having an inclination with respect to such a longitudinal axis comprised between 5° and 80° and, still more preferably, between 25° and 65°.

In this way, it is advantageously possible to provide the suction head with an element which reduces its cross section and that, in the case of particularly cohesive sediments (e.g. compact clay), allows to obtain a suitably reduced cross-section area of the suction opening, so as to increase the suction speed and therefore the sediment removal capacity by the head.

In a preferred embodiment, this reducing element can comprise a plurality of cut-outs formed at the peripheral edge of the suction opening so as to avoid the triggering of possible cavitation phenomena in the case of accidental contact with the water bed.

In a further preferred embodiment, the suction head further comprises an intermediate portion interposed between said first and second portion of the suction head.

In a first preferred embodiment, this intermediate portion has a substantially constant cross-section area.

In a second preferred embodiment, the intermediate portion comprises a lower portion proximal to the suction opening and having a progressively increasing cross-section area moving away from said opening and an upper portion distal with respect to the suction opening and having a progressively decreasing cross-section area moving away from the lower portion.

In this case, the intermediate portion is preferably formed of two mutually adjacent end portions of the aforementioned first and second portion of the suction head and having a lower inclination with respect to the longitudinal axis of the suction opening with respect to the remaining part of the first and of the second portion, respectively.

As a consequence of this, the intermediate portion thus has, in the lower part, a progressively increasing cross-section area moving away from the suction opening (even if to a lesser extent with respect to what occurs in the lower portion of the head due to the greater inclination of the first portion of the suction head) and, in the upper part, a progressively decreasing cross-section area moving away from the end portion of the first portion of the suction head (even if to a lesser extent with respect to what occurs in the upper portion of the head due to the greater inclination of the second portion of the suction head).

Preferably, the lower portion of the intermediate portion (preferably consisting of the upper end of the first portion of the suction head) has an inclination with respect to the longitudinal axis of the suction opening comprised between 0° and 80° and, still more preferably, between 20° and 65°.

Preferably, the upper portion of the intermediate portion (preferably consisting of the lower end of the second portion of the suction head) has an inclination with respect to the longitudinal axis of the suction opening comprised between 100° and 180° and, still more preferably, between 115° and 160°.

Within the framework of the preferred embodiment in which the suction head comprises an intermediate portion interposed between the first and the second portion of the suction head, it is particularly preferable and advantageous that the aforementioned perforated partition, if present, is supported in the suction head at said intermediate portion of the suction head.

Thanks to the configuration of the intermediate portion of the suction head and, particularly when the head has a double inclination, it is possible to achieve the following advantageous technical effects:

- preventing the solid material having a size smaller than the passage section of the holes made in the perforated partition from being trapped between the lower wall of the head and the perforated partition and thus not passing beyond the latter;
- preventing the solid material having a size greater than the passage section of the holes made in the perforated partition from being trapped between the lower wall of the head and the perforated partition thus making it difficult to carry out the operation of emptying the area of the head upstream of the perforated partition (the portion proximal to the suction opening); and
- preventing solid material having a size smaller than the passage section of the holes made in the perforated partition from being trapped between the upper wall of the head and the perforated partition thus preventing it from being drawn by the pump.

Preferably, the aforementioned first and/or second portion and/or intermediate portion of the suction head has a substantially frusto-conical shape so as to facilitate manufacturing operations thereof.

In an alternative preferred embodiment, the aforementioned first and/or second portion of the suction head (including the optional end portion having a different inclination and/or the intermediate portion, if present) can consist of faceted walls comprising a plurality of planar segments suitably inclined with respect to the longitudinal axis of the suction opening and connected side-by-side.

For the purposes of the invention, the suction head can be integrally made as a single piece or, alternatively, it can consist of two or more structurally independent portions (for example a lower portion, an upper portion and optionally an intermediate portion) removably associated to one another by means of conventional fixing means, such as, for example, a plurality of bolts inserted in a flange or in suitable radially outer fins that are suitably perforated.

In this case, it is advantageously possible to mount in a removable manner the perforated partition between the head portions and dismount the suction head (perforated partition included) thus facilitating the cleaning and maintenance operations thereof.

In a further preferred embodiment, the portion of the suction head distal with respect to the suction opening can be provided with one or more inspection ports so as to be able to inspect the inner space of the suction head and verify the need for a possible intervention to remove solid materials held by the perforated partition and/or to carry out maintenance or repair interventions.

In a further preferred embodiment, the dredging apparatus comprises a plurality of flow deflecting elements associated to the suction head close to said suction opening.

In this way, it is advantageously possible to impart particular and advantageous orientations to the water flow sucked both upstream and downstream of the suction opening of the head as a function of the inner and/or outer position, of the flow deflecting elements on the suction head itself.

Thus, in a first preferred embodiment, the flow deflecting elements can be externally positioned on the suction head close to the suction opening: in this way, it is advantageously possible to facilitate the erosion of the sediments by the water flow drawn towards the suction opening, according to a highly-directed radial or rotary movement of the centrifugal type, in particular when the sediments have a compact nature.

In a further preferred embodiment, the flow deflecting elements can be internally positioned in the suction head close to the suction opening: in this way, it is advantageously possible to impart to the sucked water/sediment slurry a highly-directed radial or rotary movement of the centrifugal type that facilitates its conveying towards the inlet mouth of the pump.

Clearly, it is also possible to have both an inner and an outer configuration of the flow deflecting elements thereby achieving an advantageous combination of the aforementioned technical effects.

Within the framework of these preferred embodiments, the flow deflecting elements preferably consist of a plurality of fins having a substantially rectilinear or curvilinear shape extending along a radial direction or along an inclined direction with respect to said radial direction.

In this way, it is advantageously possible to achieve the desired deflection effect of the liquid flow in a mechanically simple way, by imparting thereto a substantially rectilinear highly-directed motion or a substantially rotary motion of the centrifugal type.

In a preferred embodiment, the dredging apparatus further comprises a separating device for separating the slurry of water and sediments discharged from the suction apparatus into a liquid phase and a solid phase including the sediments.

For the purposes of the invention, any suitable solid-liquid separating device can be used, such as for example a centrifugal cyclone separator, a diaphragm filter, a vibrating or roto-vibrating screen or a flotation system.

In this way, it is advantageously possible both to recover the sediments for a subsequent treatment, storage or reuse thereof, and to have a water flow substantially free of sediments that can be recirculated to the suction head as will be illustrated hereinbelow.

Preferably, the separating device is on the surface and is installed on a hull of the dredging apparatus on which the elements for controlling and positioning the suction head and the submersible pump are installed.

Within the framework of this preferred embodiment, the dredging apparatus preferably comprises a recirculation system to the suction head, in particular towards its suction opening, of at least a part of the liquid phase separated by said separating device.

Preferably, the recirculation system is of the "passive" type, in other words it is not provided with any further apparatus, for example a pump, for pressurising and to actively recirculating the liquid phase towards the suction head, but it just comprises one or more ducts for conveying the recirculated liquid phase to the suction head in particular towards its suction opening.

In this preferred embodiment of the invention, the liquid phase is thus recirculated towards the suction opening of the suction head in a "passive" manner; more specifically, the liquid phase is drawn towards the opening of the suction head thanks to the depression that is created at and close to such an opening by the submersible pump provided downstream of the suction head and which constitutes the sole liquid-moving member in the dredging apparatus.

In this way, it is advantageously possible to recirculate towards the suction opening of the suction head at least a part of the liquid phase separated by the separating device, preferably all of the liquid phase separated except for the part that remains in the form of residual humidity in the sediments separated and/or cleaned up, without any additional driving element, but simply exploiting the action of the submersible pump which is in any case already provided to suck the sediments in the dredging apparatus.

Preferably, the recirculation system also defines an actual closed hydraulic circuit, meaning with this term that the fluid recirculating in the circuit does not substantially come into contact with the environment outside the head.

The recirculation fluid which continuously recirculates in the aforementioned closed hydraulic circuit without substantial exchanges of matter with the outside environment advantageously carries out a diluting function of the water/sediment slurry sucked by the suction head adjusting its density (given by the concentration of solids) to values compatible with the correct operation of the circuit downstream of the submersible pump, thus optimising the efficiency of the overall system for sucking and discharging the slurry, as well as of the solid/liquid separating device that is fed with a slurry having density characteristics that are constant, controlled and adjustable as desired.

Preferably, the suction head is provided in this preferred embodiment with an inner hollow space defining an outer annular portion of said suction opening and in liquid communication with the recirculation system for feeding the liquid phase separated by the separating device towards the suction opening and inside the suction head.

Preferably, the first portion described above of the suction head is provided with a jacket forming a double wall (inner and outer) portion of the suction head wherein the aforementioned hollow space, which is thus located within the head, is defined.

In this preferred embodiment, therefore, such a jacket defines the outermost wall of the first portion of the suction head (or of part of the same) as well as the outermost perimeter of the suction opening of the head.

In this preferred embodiment, therefore, the minimum size of the opening defined by the inner wall of the first portion of the suction head (minimum diameter in the case of a circular opening) in the presence of the aforementioned hollow space is 70 mm, whereas the maximum size (maximum diameter in the case of a circular opening) is 1100 mm. More preferably, the size of the opening defined by the inner wall of the first portion of the suction head (diameter in the case of a circular opening) is comprised between 135 mm and 850 mm and, still more preferably, between 210 mm and 650 mm.

Preferably, the cross-section area of the opening defined by the inner wall of the first portion of the suction head is in this case comprised between 0.004 and 0.90 $m^2$ so as to take into account the section of the hollow recirculation space. More preferably, the cross-section area of the opening defined by the inner wall of the first portion of the suction head is comprised between 0.015 and 0.56 $m^2$ and, still more preferably between 0.035 and 0.32 $m^2$.

In this way, it is possible to carry out the suction of the sediments by optimising the percentage of solid in the sucked slurry and giving the recirculation system the task of keeping the dredging system balanced and, consequently, to ensure a feeding continuity to the subsequent steps of separation and/or decontamination.

This additional preferred embodiment of the dredging apparatus allows to obtain a series of relevant advantageous technical effects, including:

- increasing the erosion action of the sediments and consequently the efficiency of the dredging operations thanks to the feeding of a predetermined flow rate of the liquid phase separated by the separating device towards the suction opening of the head according to a highly-directed flow;
- effective confinement of the suction area of the sediments within the perimeter of the suction opening (in this case also including the hollow space defined within the suction head and defining an outer annular portion of the suction opening) preventing the occurrence of any potential water turbidity phenomena;
- possibility of keeping the sucked water in a substantially closed circuit, which circuit being possibly sealable at the end of the dredging operations, which is a particularly useful option in the case of polluted locations in which it is not possible or desirable to discharge the liquid phase separated on land or in the water;
- possibility of using and recirculating a limited amount of recirculation water which amount the recirculation system, preferably defining a closed hydraulic circuit, "automatically" maintains at substantially constant values by withdrawing water from the surrounding environment, with obvious benefits in terms of installation and operating costs of the entire dredging system.

Within the framework of this preferred embodiment, it is preferable and advantageous to arrange a plurality of flow deflecting elements in the aforementioned hollow space close to said suction opening.

Similarly to what has been outlined above, the flow deflecting elements preferably comprise a plurality of fins having a substantially rectilinear or curvilinear shape extending along a radial direction or along an inclined direction with respect to said radial direction and they achieve the same advantageous technical effects of imparting also to the flow of liquid phase recirculated towards the suction opening a highly-directed substantially radial movement or a substantially rotary movement of the centrifugal type which increases the efficiency of the fluid-dynamic removal action of the sediments.

Moreover, the possibility of imparting a highly-directed movement to the flow of liquid phase recirculated towards the suction opening is extremely advantageous whenever polluted locations are dredged, since it allows to avoid any type of reintroduction into the environment of the polluting substances deposited on the sediments held by the perforated partition and it determines, within the lower portion of the suction head, an accurate cleaning and washing of the sediments held by the perforated partition substantially eliminating any possible pollution risk due to a sediments release from the head at the end of the dredging operations.

In this case, moreover, the flow deflecting elements advantageously constitute at the same time respective mechanical stiffening elements which contribute to strengthen the hollow space defined in the suction head.

In a further preferred embodiment, the dredging apparatus can comprise one or more suitable shut-off valves which may be operated in the start-up and/or stopping steps of the submersible pump and having the function of preventing an undesired back-flow of the slurry sucked by the suction head and of sealing the "passive" recirculation system (as stated essentially consisting of one or more ducts) thus avoiding the escape from the recirculation system of the recirculated part of the liquid phase possibly containing polluting substances.

Preferably, the dredging apparatus comprises a first shut-off valve, for example a check valve of the swing type, mounted on a discharge duct of the slurry of water and sediments sucked by the suction head and extending downstream of the discharge opening of the housing body of the submersible pump.

Preferably and in the preferred embodiment in which the dredging apparatus comprises the aforementioned recirculation system, the first shut-off valve is mounted on a discharge duct extending between the discharge opening of the housing body of the submersible pump and the separating device.

Preferably, the dredging apparatus also comprises a second shut-off valve, for example a throttle valve, mounted on a recirculation duct of the liquid phase separated by the separating device to the suction opening of the suction head.

The presence of these shut-off valves is extremely advantageous whenever polluted locations are dredged, since it allows to avoid any type of reintroduction into the environment of pollutants, be they present in the solid phase or in the liquid phase, in case of failure of the submersible pump or of other elements of the recirculation system or in case of stopping of the dredging operations.

Within the framework of the preferred embodiment in which the aforementioned separating device is provided, the dredging apparatus preferably comprises a unit for chemically treating the liquid phase separated by the separating device.

In this way, it is advantageously, possible to carry out an inertisation or neutralisation treatment of dissolved or suspended polluting substances present in the polluted sites, thus allowing to carry out not only dredging operations but also an actual decontamination of the site.

For the purposes of the invention, this chemical treatment unit comprises suitable devices (such as for example tanks for collecting the dredged liquid phase and/or reactors for its treatment, ion exchange or active carbon columns, tanks for collecting and dosing suitable reactants, filters or apparatuses for solid-liquid separation, and so on) adapted to carry out an inertisation and/or neutralisation treatment of any polluting substances present in solution or suspension in the liquid phase.

Preferably, the chemical treatment unit is located on the surface and is installed on the hull of the dredging apparatus on which the separating device and the control and positioning elements of the suction head and of the submersible pump are installed.

Dredging Method

In a preferred embodiment of the dredging method of the invention and as outlined above, the suction speed is comprised between 0.3 and 30 m/s as a function of the particle size and cohesion characteristics of the sediments and, more specifically, as a function of the particle size and cohesion characteristics of the material to be sucked; of the degree of contamination by foreign bodies and of the size thereof; of the suction depth and of the percentage of solids in the water/sediment slurry that should be obtained.

Preferably, the suction speed is comprised between 1 and 25 m/s and, still more preferably, between 2 and 20 m/s as a function of the particle size and of the cohesion characteristics of the sediments.

Even more preferred values of the suction speed as a function of the particle size and of the characteristics of the sediments are as follows:

- silts (cohesion varying between 10 KPa and 0.5 MPa measured according to SPT (Standard Penetration Test)) having an average Wentworth particle size ≤60 μm: 0.4-10 m/s;
- sands having an average Wentworth particle size comprised between 60 μm and 3 mm: 0.4-20 m/s;
- gravels having an average Wentworth particle size comprised between 3 mm and 100 mm: 0.8-15 m/s;
- pebbles having an average Wentworth particle size ≥100 mm: 0.8-10 m/s.

In a preferred embodiment, the dredging method further comprises the step of reducing the average speed of the water/sediment slurry sucked inside the suction head downstream of the suction opening.

Preferably, this speed reduction step is carried out by means of the aforementioned increase of the cross-section area of the lower portion of the suction head proximal to the suction opening and it allows an adequate slowing down of the sucked solid material (sediments but also broken stone or various kinds of debris).

Preferably and as outlined above, the average speed of the slurry at the maximum cross-section area of the suction head is comprised between 0.1 m/s and 25 m/s.

In a preferred embodiment, the dredging method further comprises the step of carrying out a particle size separation, within the suction head, of the sediments incorporated in the water/sediment slurry sucked into said head.

Preferably and as outlined above, this step can be carried out by means of the perforated partition described above.

Advantageously and as outlined above, it is possible in this case to achieve, with respect to known dredging apparatuses, not only a greater operating flexibility of the dredging method, since possible solid residues of large dimensions are no longer capable of interfering with the operation of the suction head, but also the possibility of separating solid material of large dimensions from the finer sediments, by carrying out a first particle size classification of the sediments and by holding such material in the area of the head upstream of the perforated partition for subsequent recovery and removal.

By carrying out also the aforementioned step of reducing the average speed of the water/sediment slurry downstream of the suction opening, this preferred embodiment of the method of the invention allows to achieve the additional important advantageous technical effects of

- limiting the mechanical stresses on the perforated partition;
- limiting the wearing phenomena due to impacts on the perforated partition;
- allowing a sufficient autonomy of operation between a cleaning operation of the area upstream of the perforated partition and the next one; —carrying out a prior particle size separation of the sediments to be drawn so as to optimise the subsequent steps of separation and/or decontamination; and
- carrying out, during the dredging operations, an accurate washing of the sediments held by the perforated partition.

In a preferred embodiment, the dredging method further comprises the step of separating a slurry of water and sediments discharged by the submersible pump in a liquid phase and a solid phase including the sediments.

In this way and as outlined above, it is advantageously possible both to recover the sediments for their subsequent treatment, storage or reuse, and to have a flow of water substantially free of sediments that can be recirculated to the suction head.

Preferably and as outlined above, this separation step can be carried out by means of the separating device described above.

In this preferred embodiment, the method preferably comprises a step of recirculating a predetermined flow rate of the liquid phase towards the suction opening of the suction head.

In this way and as outlined above, it is advantageously possible to achieve the following technical effects:

- increasing the erosion action of the sediments and consequently the efficiency of the dredging operations thanks to the feeding of the liquid phase separated by the separating device towards the suction opening of the head;
- effectively confining the suction area of the sediments blocking any possible water turbidity effect;
- possibility of keeping the sucked water in a substantially closed circuit, which circuit being possibly sealable at the end of the dredging operations, which is a particularly useful option in the case of polluted locations in which it is not possible to discharge the separated liquid phase on land or in water.

Preferably and as outlined above, these steps can be carried out by means of the recirculation system and of the inner hollow space located within the suction head described above.

Preferably, the recirculation step of the liquid phase is carried out by means of the aforementioned inner hollow space located within the suction head, which hollow space is advantageously capable of directing a highly-directed liquid flow towards the suction opening, thereby increasing the erosion action of the sediments and more effectively confining the suction area of the sediments.

In a preferred embodiment of the dredging method, the liquid phase recirculated towards the suction opening has a speed equal to or lower than the suction speed.

In this way, it is advantageously possible to keep the desired depression conditions at the suction opening and ensure that the recirculated liquid phase is substantially confined in a closed hydraulic circuit substantially inside the perimeter of the aforementioned suction opening without any substantial disturbing action of the sediments and any undesired generation of turbulence which may bring the sediments in suspension.

Preferably, the absolute pressure value at the suction opening is kept at values comprised between 0.1 and 0.9 bar, more preferably between 0.2 and 0.7 bar, by suitably adjusting the speed of the liquid phase recirculated towards such an opening.

Moreover and if the speed of the liquid phase recirculated towards the suction opening is lower than the suction speed it is advantageously possible to achieve the additional technical effect of drawing a further flow of water from the areas around the suction opening of the head thus contributing to increase the peripheral erosion action of the sediments without substantial contact with the water bed, compensating at the same time any losses of the recirculated liquid phase.

In a preferred embodiment of the dredging method of the invention, the liquid phase recirculated towards the suction opening has a speed comprised between 0.2 and 15 m/s as a function of the suction speed values given above.

More preferably, the liquid phase recirculated towards the suction opening has a speed comprised between 0.5 and 10 m/s and, still more preferably, between 1 and 5 m/s as a function of to the preferred suction speed values given above.

In a preferred embodiment of the dredging method of the invention, the ratio between the suction speed of the water/sediment slurry and the speed of the liquid phase recirculated towards the suction opening is comprised between 1 and 7, more preferably between 1 and 5 and, still more preferably, between 1 and 2.

In further preferred embodiments, the dredging method further comprises one or more of the steps of:

- imparting to the water sucked into the head a substantially rotary movement or a substantially radial movement with respect to the suction opening;
- imparting on the recirculated liquid phase fed close to the suction opening a substantially rotary movement or a substantially radial movement with respect to the suction opening,
- eroding the sediments from the bed by channelling the water present close to the suction opening outside the head in the radial direction towards the suction opening.

Preferably, these preferred steps can be carried out by means of the above described flow deflecting elements located inside (for example within the hollow space formed within the head) and/or outside of the suction head as illustrated earlier.

Advantageously and as outlined above, these steps allow to create a highly-directed flow of liquid towards the suction opening, thereby optimising the fluid-dynamics of the dredging operations, increasing their efficiency and reducing their times and costs.

In a preferred embodiment, the dredging method further comprises the step of chemically treating the liquid phase separated from the slurry of water and sediments.

Preferably, this step can be carried out by means of the aforementioned chemical treatment unit and it achieves the advantages outlined above in relation to the description of such a unit.

In a preferred embodiment, the dredging method further comprises a stand-by step including a step of sealing a predetermined amount of the recirculated liquid phase separated from the slurry of water and sediments in a closed circuit.

Preferably, this step can be carried out by means of the aforementioned shut-off valves respectively mounted on the discharge duct of the slurry of water and sediments extending downstream of the discharge opening of the housing body of the submersible pump and on the recirculation duct of the liquid phase separated by the separating device to the suction opening of the suction head.

BRIEF DESCRIPTION OF THE FIGURES

Additional features and advantages of the present invention will become more readily apparent from the following detailed description of some preferred embodiments of a dredging apparatus according to the invention, made hereafter by way of explanation and not of limitation with reference to the attached drawings. In the drawings.

DETAILED DESCRIPTION OF THE CURRENTLY PREFERRED EMBODIMENTS

Figure 1:
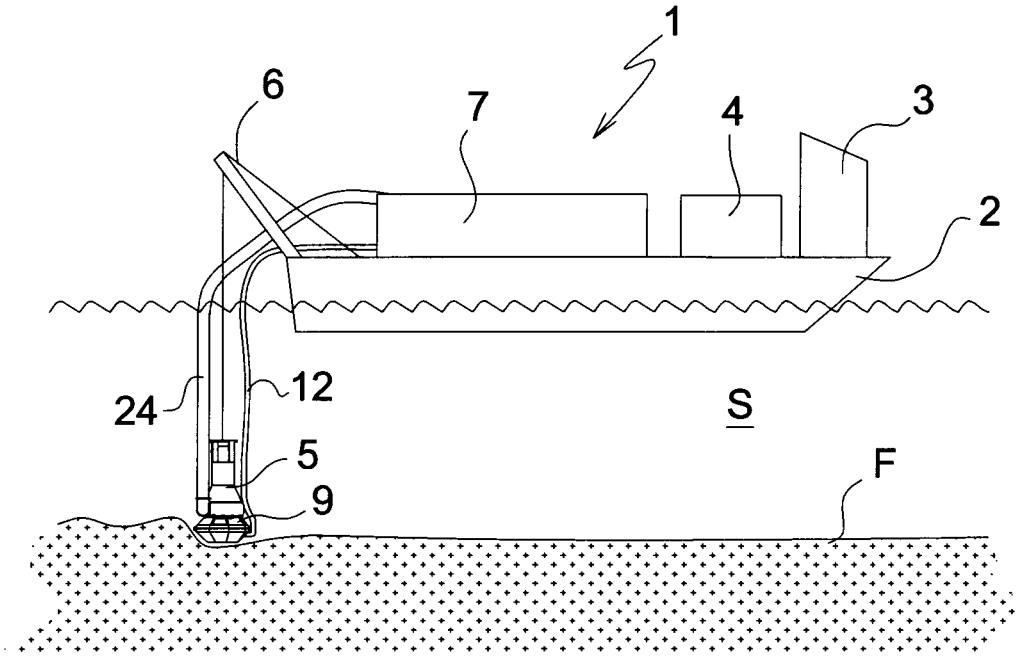
FIG. 1 is a schematic view of a preferred embodiment of a dredging apparatus according to the invention.

With reference to FIGS. 1-5, a dredging apparatus according to a first preferred embodiment of the invention, for example a dredging apparatus of the so-called sucking-discharging type for removing sediments from a bed F of an expanse of water S like for example a sea bed, river bed, lake bed, marsh bed, etc, is generally indicated at 1.

The dredging apparatus 1 comprises a hull 2, preferably constituted by a plurality of modular bridge units (not illustrated in greater detail), conventionally supporting a driving station 3, inside which a driving panel is positioned to drive all of the displacement operations of the hull and actual dredging operations by means of suitable driving devices, a power station 4 for operating a submerged suction apparatus 5 and a lifting frame 6 for moving the suction apparatus 5.

The power station 4 comprises in turn an endothermic engine (for example a diesel engine) and a hydraulic or electric control unit, not better shown in FIG. 1, to hydraulically or electrically operate the submerged suction apparatus 5 as will become clearer hereinafter.

The dredging apparatus 1 also comprises one or more tanks of a suitable fuel of the endothermic engine and one or more devices for moving the hull 2, both of the conventional type and not shown.

The hull 2 also conventionally supports a work station 7 comprising:

- a separating device 8 for the separation of a slurry of water and sediments coming from the suction apparatus 5, for example a separating device of the diaphragm type (see FIG. 2), for separating a slurry of water and sediments discharged from the suction apparatus 5 in a liquid phase and a solid phase including the sediments;
- a recirculation system 10 to a suction head 9 of the suction apparatus 5 of at least a part of the liquid phase separated by the separating device 8, comprising a tank 11 for collecting the liquid phase separated by the separating device 8 and at least one recirculation duct 12 to the suction head 9 of the separated liquid phase;
- a unit 13 for chemically treating the liquid phase separated by the separating device 8, for example including a tank 14 for neutralizing the pollutants in fluid communication with the tank 11 of the recirculation system 10 by means of a pair of ducts 15, 16 for feeding the liquid phase to the tank 14 and for returning the neutralized liquid phase to the tank 11.

Figure 2:
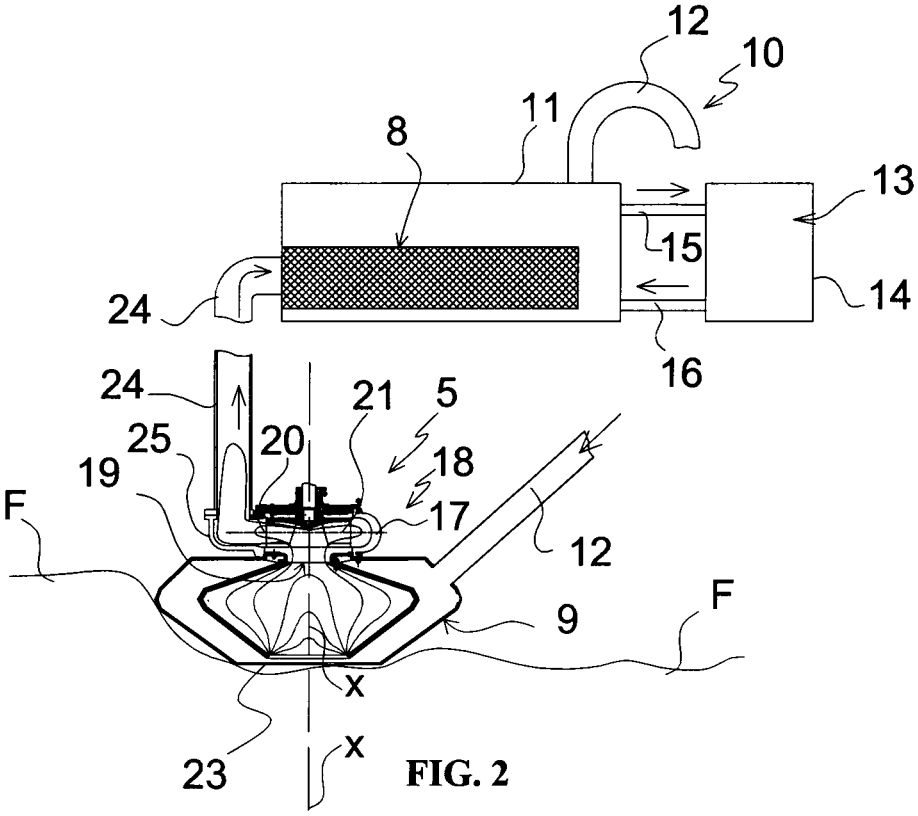
FIG. 2 is a schematic view showing some details of the dredging apparatus of FIG. 1 in an operative condition thereof.
Figure 3:
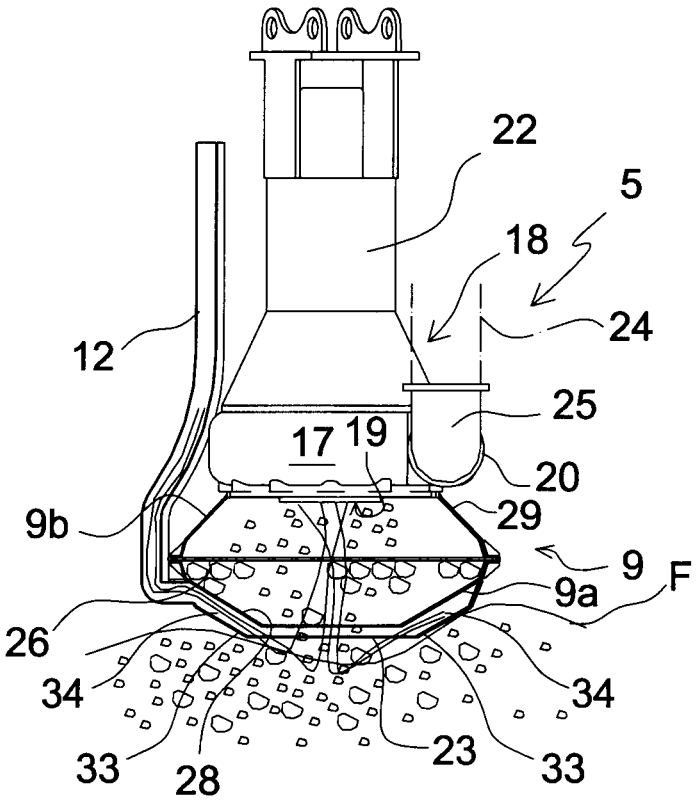
FIG. 3 is a schematic axonometric view partially in cross section of the suction apparatus of the dredging apparatus of FIG. 1.
Figure 4:
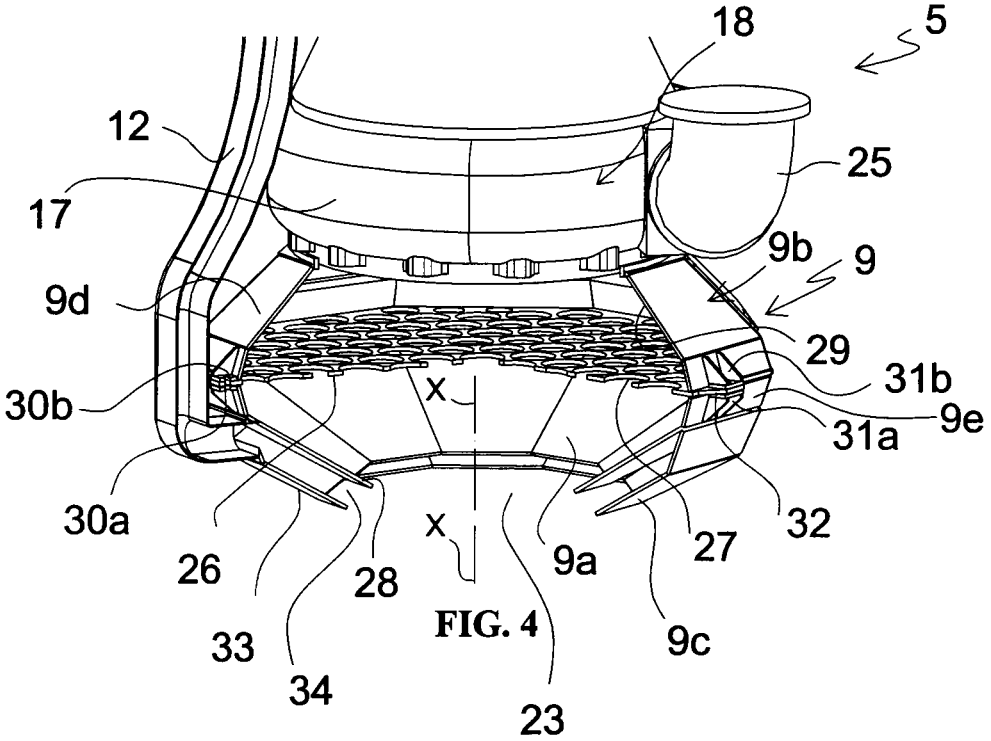
FIG. 4 is a schematic axonometric view partially in cross section and in enlarged scale of some details of the suction apparatus of the dredging apparatus of FIG. 1.

The suction apparatus 5 includes, as better illustrated in FIGS. 2-4:

a) a submersible pump 18 including:

- a housing body 17 provided with an inlet mouth 19 and with a discharge opening 20;
- an impeller 21 rotatably supported in the body 17 between the inlet mouth 19 and the discharge opening 20 and rotatably driven by a respective driving device 22, in particular a motor operated by the control unit of the power station 4; and b) the aforementioned suction head 9, which is associated to the inlet mouth 19 of the housing body 17 of the pump 18 and provided at the bottom with a suction opening 23 of the sediments.

In a way known per se, the discharge opening 20 of the housing body 17 of the pump 18 is in fluid communication with the separating device 8 by means of a duct 24 (shown with a dashed line in FIG. 3) for sending the slurry of water and sediments discharged by the suction apparatus 5, said duct being connected to the body 17 by means of a flanged pipe fitting 25.

The suction opening 23 of the head 9 has a cross-section area dimensioned to achieve, in the working range of the pump 18, a suction speed capable of removing the sediments by means of the fluid dynamics removal action carried out by the water sucked into the head 9.

In the preferred embodiment illustrated, the suction opening 23 of the head 9 has a cross-section area smaller than the maximum cross-section area of the suction head 9.

In this way, it is advantageously possible to create, in the suction head 9, a calibrated section that generates a strong depression and a consequent high suction speed of the water or of the water/sediment slurry.

Preferably, the average suction speed, measured at the suction opening 23 of the head 9, varies between 0.3 m/s and 30 m/s essentially according to the particle size and cohesion characteristics of the sediments.

In the preferred embodiment illustrated, the suction head 9 comprises a first portion 9*a* proximal to the suction opening 23 having a progressively increasing cross-section area moving away from the opening 23 and a second portion 9*b* distal with respect to the suction opening 23 having a progressively decreasing cross-section area moving away from the first portion 9*a*.

In the preferred embodiment illustrated, the suction head 9 comprises, inside the same, a perforated partition 26 supported in the head 9 downstream of the suction opening 23 and adapted to hold solid material having a size exceeding the passage section of holes 27 made in the partition 26.

In the preferred embodiment illustrated, the holes 27 are uniformly distributed in the part of the partition 26 crossed by the liquid, they are preferably circular in shape and they preferably have a diameter comprised between 15 mm and 300 mm, so as to define a cross-section passage area preferably comprised between 175 and about 75000 $mm^2$.

Advantageously, by positioning the perforated partition 26 within the suction head 9 it possible to achieve the following advantages with respect to known dredging apparatuses:

- greater operating flexibility of the dredging apparatus 1 since any solid residues of large size are no longer capable of interfering with the operation of the suction head, and
- possibility of separating the solid material having a particle size exceeding the passage section of the holes 27 from the rest of the sediments, by holding such material during the dredging operations in the area of the head 9 upstream of the perforated partition 26 for subsequent recovery and removal thanks to the depression conditions generated within the head 9.

Since the suction opening 23 of the head 9 has a cross-section area smaller than the maximum cross-section area of the suction head 9, the following important advantageous technical effects are also achieved:

- limiting the mechanical stresses on the perforated partition 26;
- limiting the wearing phenomena due to impacts on the perforated partition 26;
- allowing a sufficient autonomy of operation between one cleaning operation of the area upstream of the perforated partition 26 and the next one;
- carrying out a prior particle size classification of the sucked sediments so as to optimise the subsequent steps of separation and/or decontamination; and
- washing the sediments held by the perforated partition 26, an operation that is particularly important in dredging operations of contaminated sites.

Thanks to the aforementioned geometric configuration of the portion 9*a* of the head 9, it is advantageously possible to progressively slow down the speed of the water/sediment slurry sucked into the head 9 and facilitate the emptying of the suction head 9 from the debris held upstream of the perforated partition 26 present in the head 9.

In this way, it is thus advantageously possible to optimise from the geometric and fluid-dynamic point of view the area of the suction head 9 proximal to the suction opening 23 upstream of the perforated partition 26.

Preferably, the suction head 9 comprises, in the aforementioned first portion 9*a* proximal to the suction opening 23, a lower wall 28 having an inclination with respect to a longitudinal axis X-X of the suction opening 23 comprised in the range of numerical values indicated above.

In this way, it is thus advantageously possible to optimise from the geometric and fluid-dynamic point of view the area of the suction head 9 proximal to the suction opening 23 upstream of the perforated partition 26.

Preferably, the suction head 9 comprises, in the aforementioned second portion 9*b* distal with respect to the suction opening 23, an upper wall 29 having an inclination with respect to the longitudinal axis X-X of the suction opening 23 comprised in the range of numerical values indicated above.

Thanks to the aforementioned geometric configuration of the portion 9*b* of the head 9, it is advantageously possible to optimise from the geometric and fluid-dynamic point of view the area of the suction head 9 distal with respect to the suction opening 23 downstream of the perforated partition 26 in particular improving the fluid-dynamic efficiency of the head 9 close to the inlet mouth 19 in the body 17 of the pump 18, thereby optimising the operation thereof.

In the preferred embodiment illustrated, the suction head 9 consists of two or more structurally independent portions, in this case consisting of the portion 9*a* proximal to the suction opening 23 and of the second portion 9*b* distal with respect to such an opening, removably associated to one another by means of a plurality of bolts (not shown) inserted in respective through holes 30*a*, 30*b* formed in respective radially outer fins 31*a*, 31*b* extending from a peripheral edge of the portions 9*a* and 9*b*.

Preferably, the suction head 9 further comprises an intermediate portion 9*e* comprising a lower portion proximal to the suction opening 23 and having a progressively increasing cross-section area moving away from said opening and an upper portion distal with respect to the suction opening 23 and having a progressively decreasing cross-section area moving away from the lower portion (see FIG. 4).

In this case, the intermediate portion 9*e* is thus preferably formed of two mutually adjacent end portions of the portions 9*a*, 9*b* of the suction head 9 and having a lower inclination with respect to the longitudinal axis of the suction opening 23 with respect to the remaining part of the first portion 9*a* and, respectively, of the second portion 9*b*.

Preferably, the lower portion of the intermediate portion 9*e* has an inclination with respect to the longitudinal axis of the suction opening comprised in the range of numerical values indicated above.

Preferably, the upper portion of the intermediate portion 9*e* has an inclination with respect to the longitudinal axis of the suction opening comprised in the range of numerical values indicated above.

In this preferred embodiment, the perforated partition 26 is also provided with corresponding radial fins 32 perforated so as to be able to be mounted between the portions 9*a* and 9*b* of the suction head 9 preferably at a transversal mid-plane of the intermediate portion 9*e* of the head 9.

In this preferred configuration, it is advantageously possible to dismount the suction head 9 and the perforated partition 26, facilitating the cleaning and maintenance operations thereof.

Moreover, thanks to the configuration with a double inclination of the intermediate portion 9*e* of the suction head 9 it is possible to achieve the following advantageous technical effects:

- preventing the solid material having a size smaller than the passage section of the holes 27 formed in the perforated partition 26 from being trapped between the lower wall 28 of the head 9 and the partition 26 and thus not passing beyond the same;
- preventing the solid material having a size greater than the passage section of the holes 27 made in the partition 26 from being trapped between the lower wall 28 of the head 9 and the partition 26 thus making it difficult to carry out the operation of emptying the area of the head upstream of the partition 26 (the portion proximal to the suction opening 23); and
- preventing solid material having a size smaller than the passage section of the holes 27 formed in the partition 26 from being trapped between the upper wall 29 of the head 9 and the partition 26 and not drawn by the pump 18.

In the preferred embodiment illustrated, the lower wall 28 of the portion 9*a* proximal to the suction opening 23 and the upper wall 29 of the second portion 9*b* distal with respect to such an opening (including the adjacent end portions forming the intermediate portion 9*e* of the head 9) are faceted and comprise a plurality of planar segments 9*c*, 9*d* inclined with respect to the longitudinal axis X-X of the suction opening and connected side-by-side.

In this case, there is advantageously a simplification of the manufacturing operations of the head 9 with a reduction of the relative costs.

In this way a polygonal-shaped suction opening 23 is thus defined.

In the preferred embodiment illustrated, the suction head 9 is provided with an inner hollow space 34 defining an outer annular portion of the suction opening 23 and in liquid communication with the recirculation system 10 for feeding the liquid phase separated by the separating device 8 towards the suction opening 23 and within the suction head 9.

Preferably, the first portion 9*a* of the suction head 9 is provided with a jacket 33 forming a portion 9*a* provided with an inner and outer double wall, wherein the aforementioned hollow space 34 is defined that is thus located within the suction head 9.

In this preferred embodiment, therefore, the jacket 33 defines the outermost wall of the lower part of the first portion 9*a* of the suction head as well as the outermost perimeter of the suction opening 23 of the head 9.

In the preferred embodiment illustrated and depending on the structural characteristics of the head 9, the suction opening 23 is thus polygonal in shape, in particular with 9 sides and it circumscribes a circle having a diameter comprised between 100 mm and 1500 mm thus generating a cross-section area comprised between 0.008 and 1.76 $m^2$.

Preferably, the cross-section area of the opening defined by the inner wall 28 of the first portion 9*a* of the suction head 9 is in this case comprised between 0.004 and 0.90 $m^2$ so as to take into account the section of the recirculation hollow space 34.

In this preferred embodiment, the dredging apparatus allows to achieve the following technical advantages:

- increasing the erosion action of the sediments and therefore the efficiency of the dredging operations thanks to a highly-directed feeding of the liquid phase separated by the separating device 8 towards the suction opening 23 of the head 9;
- effectively confining the suction area of the sediments with a block of any potential water turbidity phenomena.
- possibility of maintaining the sucked water in a substantially closed circuit, said circuit being optionally sealable at the end of the dredging operations, which is a particularly useful option in the case of polluted sites where it is not possible or desirable to discharge the liquid phase separated on land or in the sea.

Figure 5:
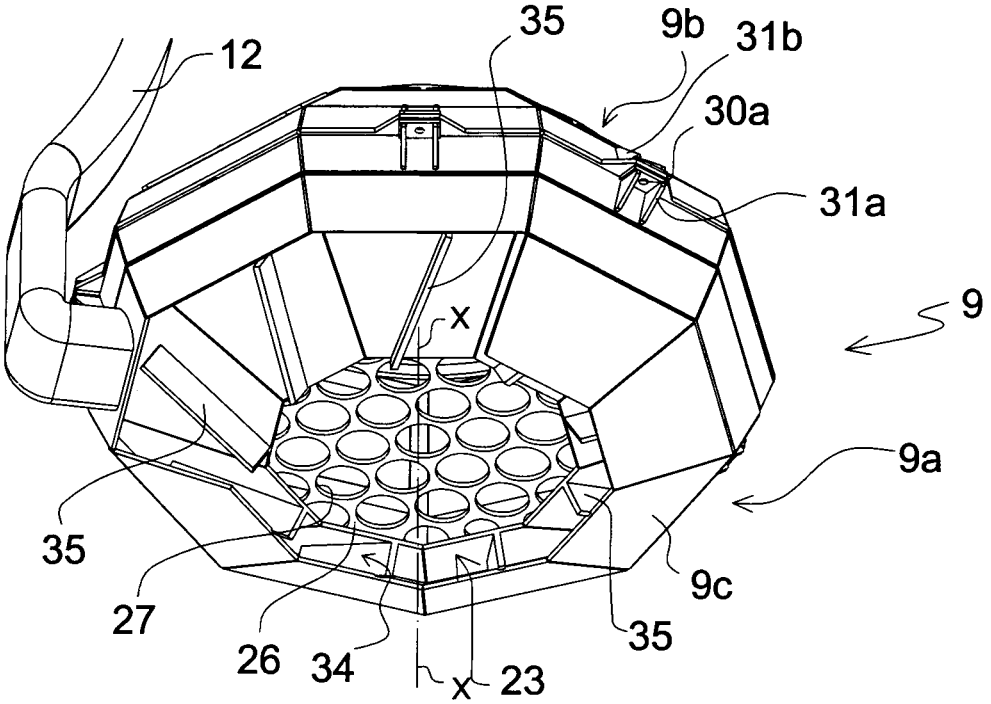
FIG. 5 is a schematic axonometric view in enlarged scale and with some parts removed of some details of a suction apparatus of a further preferred embodiment of the dredging apparatus according to the invention.

In the preferred embodiment illustrated, the dredging apparatus comprises a plurality of flow deflecting elements associated to the suction head 9 close to the suction opening 23 (FIG. 5).

In this preferred embodiment, the aforementioned flow deflecting elements are positioned in the hollow space 34 close to the suction opening 23 and consist of a corresponding plurality of substantially rectilinear fins 35 extending along an inclined direction with respect to the radial direction.

Thanks to the presence of these flow deflecting elements, the dredging apparatus 1 achieves the advantageous technical effect of imparting to the flow of liquid phase fed towards the suction opening 23 a highly-directed substantially rotary movement of the centrifugal type which increases the efficiency of the fluid-dynamic removal action of the sediments.

With reference to the dredging apparatus 1 described above and to FIGS. 1-5, a dredging method for removing sediments from the bed F of the expanse of water S will now be described.

In a first step, the method provides for positioning the suction apparatus 5 including the submersible pump 18 described above close to the water bed F.

Thereafter, a triggering step is carried out in which with the motor 22 of the pump 18 at start-up speed, the suction head 9 is brought close to the bed F by the lifting frame 6 up to a distance such that by actuating the submersible pump 18 the water drawn from the outside is forced to lap on the outer periphery of the lower portion 9*a* proximal to the suction opening 23 of the head 9 and then to discharge its kinetic energy on the bed F, eroding the same.

The erosion of the water bed F therefore starts from the periphery of the suction opening 23 and reaches the centre up to the longitudinal axis X-X by successive yielding.

As soon as the head 9 has penetrated the water bed, the submersible pump 18 is operated so as to achieve, in the working range of the pump, a suction speed capable of removing the sediments by means of the fluid dynamics removal action carried out by the water sucked into the head 9.

In this way, the dredging apparatus enters into a steady-state operating condition in which the strong depression generated at the suction opening 23 and in the areas immediately upstream thereof possesses a preferential direction axial to the head 9 and continues to draw water from the outside with a progressive erosion and removal of the sediments.

At this point it is possible to distinguish two movements of the dredging front at any vertical movement of the head 9:

- a front movement, which takes place in the same way as the triggering step; and
- a peripheral movement, which takes place by virtue of the fact that the layers of material lying over the sucked layer close to the head 9 constitute unstable fronts and consequently slip downwards.

The Applicant observed that such a mechanism, once triggered, is capable of self-feeding making the dredging operations very efficient and free from any interruptions.

In an experimental test carried out according to this preferred embodiment of the dredging method of the invention, it was found that there was a suction speed comprised between 1.1 and 3.4 m/s with a particle size of the sediments of 60-80 mm, whereas the suction flow rate was equal to about 2400 $m^3$/h.

In this preferred embodiment, the dredging method also provides the step of reducing the average speed of the water/sediment slurry sucked into the suction head 9 downstream of the suction opening 23 carried out by means of the aforementioned increase of the cross-section area of the lower portion 9*a* of the suction head 9 proximal to the suction opening 23.

Advantageously, such a preferred step allows to adequately slowing down the sucked solid material (sediments but also broken stone, or various kinds of debris).

In this preferred embodiment, the average speed of the slurry at the maximum cross-section area of the intermediate portion 9*e* of the suction head 9 (where the perforated partition 26 is mounted) is comprised between 0.3 m/s and 0.9 m/s.

In this preferred embodiment, the dredging method also comprises the step of carrying out a particle size classification within the suction head 9 of the sediments incorporated in the water/sediment slurry sucked into said head 9.

Preferably, this step is carried out by means of the perforated partition 26 described above.

Advantageously and as outlined above, it is possible in this case to achieve, with respect to known dredging apparatuses, not only a greater operating flexibility of the dredging method, since any solid residues of large size are no longer capable of interfering with the operation of the suction head 9, but also the possibility of separating solid material having a large particle size from the finer sediments, holding such material in the area of the head 9 upstream of the partition 26 for subsequent recovery and removal.

In other words, thanks to the presence of the perforated partition 26 it is possible to achieve:

- a selective withdrawal of the material according to its size;
- a greater precision in achieving the desired dredging depths.

With respect to common dredging heads, in fact, the dredging apparatus and method of the invention allow to withdraw the foreign bodies and all the material which does not pass through the partition 26 from a certain location, keep them within the suction head 9 and then deposit the same in a different area so as to be able to continue excavating the water bed F in the same location.

In common heads, on the contrary, the filter is positioned outside of the head and once it is saturated it is necessary to move the same with the consequence that the foreign bodies are deposited and thus it is not possible to continue the dredging operations in the same location.

By carrying out also the aforementioned step of reducing the average speed of the water/sediment slurry downstream of the suction opening, this preferred embodiment of the method of the invention allows to achieve the additional important advantageous technical effects of:

- limiting the mechanical stresses on the perforated partition 26;
- limiting the wearing phenomena due to impacts on the perforated partition 26;
- allowing a sufficient autonomy of operation between one cleaning operation of the area upstream of the partition 26 and the next one; and
- carrying out a prior particle size classification of the sucked sediments so as to optimise the subsequent steps of separation and/or decontamination.

In this preferred embodiment, the dredging method also comprises the step of separating the slurry of water and sediments discharged from the submersible pump 18 in a liquid phase and a solid phase including the sediments.

In this way and as outlined above, it is advantageously possible both to recover the sediments for their subsequent treatment, storage or reuse, and to have a flow of water substantially free of sediments that is at least partially recirculated to the suction head 9 by means of the duct 12 of the recirculation system 10.

This separation step is in particular preferably carried out by means of the separating device 8 described above.

Advantageously, the step of recirculating at least a part of the liquid phase separated from the slurry is carried out in a "passive" manner, thanks to the depression which is created at and close to the suction opening 23 by the submersible pump 18.

In this way, it is advantageously possible to recirculate at least a part of the liquid phase separated by the separating device 8 towards the suction opening 23 of the suction head 9 without any additional driving element, but simply by exploiting the action of the submersible pump 18 which is in any case already provided to suck the sediments in the dredging apparatus 1.

In a preferred embodiment, the dredging method comprises the step of recirculating to the head 9 substantially all of the liquid phase separated from the slurry, with the exception of the losses of the liquid which impregnates the separated solid phase, said losses being compensated by withdrawing water from the surrounding environment, and the step of feeding the recirculated liquid phase towards the suction opening 23.

In this way, the recirculated liquid phase has a speed substantially equal to the suction speed for which reason it is advantageously possible to ensure that the recirculated liquid phase is substantially confined in a closed hydraulic circuit without any substantial disturbing action of the sediments and without any undesired generation of turbulence capable of bringing the sediments in suspension.

Moreover and as outlined above, it is advantageously possible to achieve the following technical effects:

- increasing the erosion action of the sediments and therefore the efficiency of the dredging operations thanks to the highly-directed feeding of the liquid phase separated by the separating device 8 towards the suction opening of the head 23;
- effectively confining the suction area of the sediments with a block of any possible water turbidity phenomena;
- possibility of keeping the sucked water within a substantially closed circuit.

These steps are in particular carried out by means of the duct 12 of the recirculation system 10 and by the hollow space 34 defined within the suction head 9.

In this preferred embodiment, the dredging method also comprises the steps of imparting to the recirculated liquid phase fed towards the suction opening 23 a highly-directed substantially rotary movement with respect to the suction opening 23 and of eroding the sediments from the water bed F by channelling the water present close to the suction opening 23 outside of the head 9 in a tangential direction towards the suction opening 23.

These preferred steps are carried out in this case by means of the flow deflecting elements (fms 35) described above positioned within the hollow space 34 defined in the head 9.

Advantageously and as outlined above, these steps allow to optimise the fluid-dynamics of the dredging operations thereby increasing their efficiency and reducing the times and costs thereof.

In this preferred embodiment, the dredging method also comprises the step of chemically treating the liquid phase separated from the slurry of water and sediments in the separating device 8.

This step is preferably carried out by means of the chemical treatment unit 13 and it allows to achieve the advantages outlined earlier.

With reference to FIGS. 6-13 further preferred embodiments of the dredging apparatus 1 according to the invention will now be described.

In the following description and in such figures, the elements of the dredging apparatus which are structurally or functionally equivalent to those illustrated earlier with reference to FIGS. 1-5 will be indicated with the same reference numerals and will not be described any further.

Figure 6:
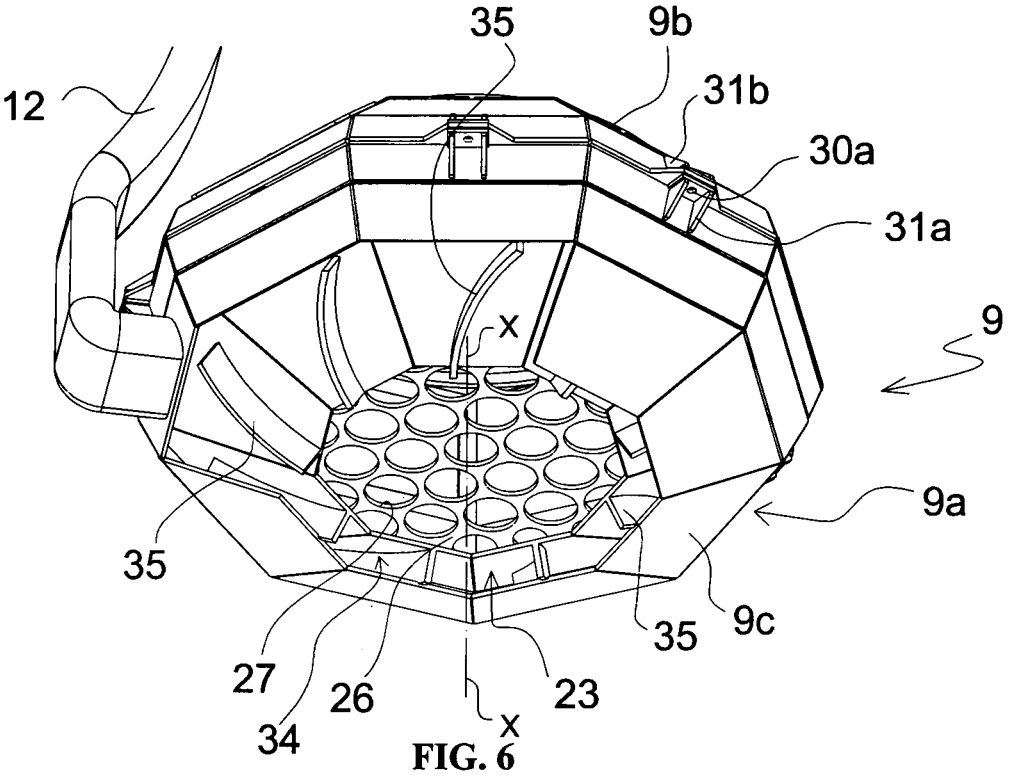
FIG. 6 is a schematic axonometric view in enlarged scale and with some parts detached of some details of a suction apparatus of a further preferred embodiment of the dredging apparatus according to the invention.

In the embodiment of FIG. 6, a variant of the suction head 9 is illustrated in which the flow deflecting elements positioned in the hollow space 34 consist of substantially curvilinear fins 35 inclined with respect to the radial direction so as to impart to the recirculated water flow a substantially rotary movement of the centripetal type which facilitates the water intake into the suction head 9 and effectively erodes the water bed F removing the sediments.

In a further alternative preferred embodiment, not illustrated, the substantially curvilinear fins 35 can be oriented in the opposite direction with respect to the radial direction (in other words with the concavity to the left of the fins with reference to FIG. 6) so as to impart to the recirculated water flow a substantially rotary movement of the tangential type with respect to the suction opening 23, achieving also in, this case an effective erosion of the water bed F.

Figure 7:
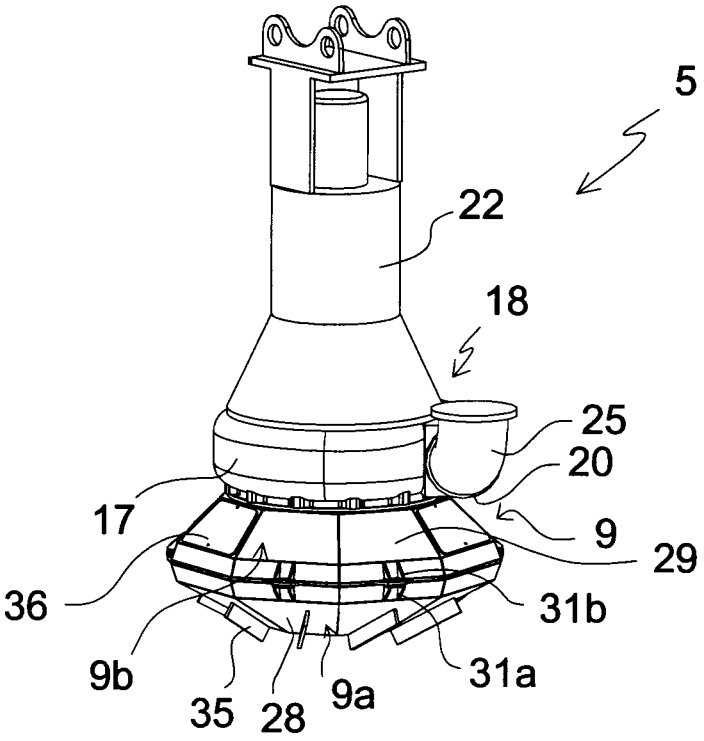
FIG. 7 is a schematic axonometric view of a suction apparatus of a further preferred embodiment of the dredging apparatus according to the invention.

FIG. 7 shows a variant of the suction apparatus 5 and of the suction head 9 in the case in which the dredging apparatus 1 lacks the recirculation system 10 of the water to the head 9.

In this preferred embodiment, the suction head 9 comprises a plurality of flow deflecting elements, consisting of respective substantially rectilinear fins 35 extending along a direction inclined with respect to the radial direction, externally associated to the first portion 9*a* of the suction head 9 close to the suction opening 23.

Thanks to the presence of these inclined fins 35, the dredging apparatus 1 achieves the advantageous technical effect of imparting to the liquid phase flow fed towards the suction opening 23 a substantially rotary movement of the centrifugal type which increases the efficiency of the fluid-dynamic removal action of the sediments.

Consequently, the dredging method carried out by means of the aforementioned dredging apparatus 1 comprises the step of imparting to the water sucked into the head 9 a substantially rotary movement oriented towards the suction opening 23.

In this preferred embodiment, the second portion 9*b* of the suction head 9 distal with respect to the suction opening 23 is provided with a plurality of inspection ports 36 which advantageously allow to inspect the inner space of the suction head 9 and to verify the need for a possible intervention to remove solid materials held by the perforated partition 26 and/or to carry out maintenance or repair interventions.

Clearly, the aforementioned inspection ports 36 can also be provided on the other embodiments of the invention.

Figure 8:
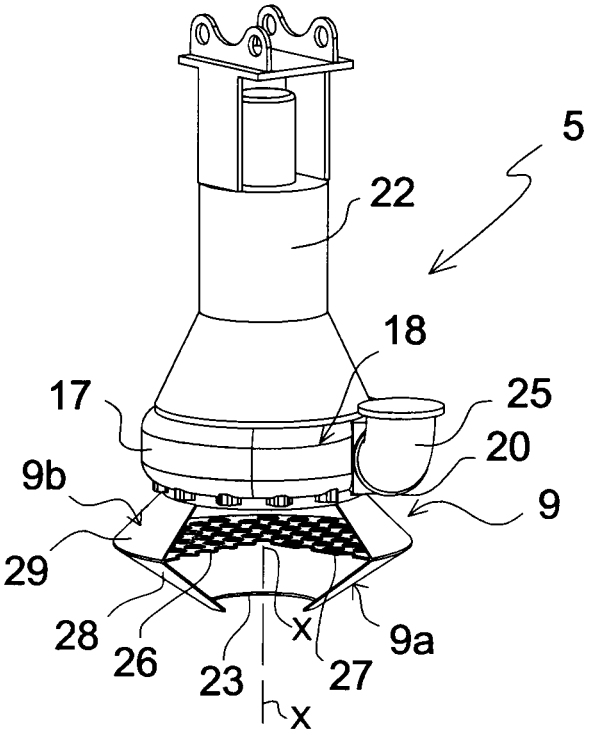
FIGS. 8-10 are as many schematic axonometric views partially in cross section of respective suction apparatuses of further preferred embodiments of the dredging apparatus according to the invention.

FIG. 8 illustrates a further preferred embodiment of the suction apparatus 5 and of the suction head 9 in the case in which the dredging apparatus 1 lacks the recirculation system 10 of the water to the head 9.

In this case, the suction head 9 is integrally formed as a single piece with the perforated partition 26, while the portions 9*a* and 9*b* of the suction head 9, respectively proximal and distal with respect to the suction opening 23, have a frustoconical shape, thereby achieving the advantageous technical effects described above in relation to the presence of this specific combination of features.

Figure 9:
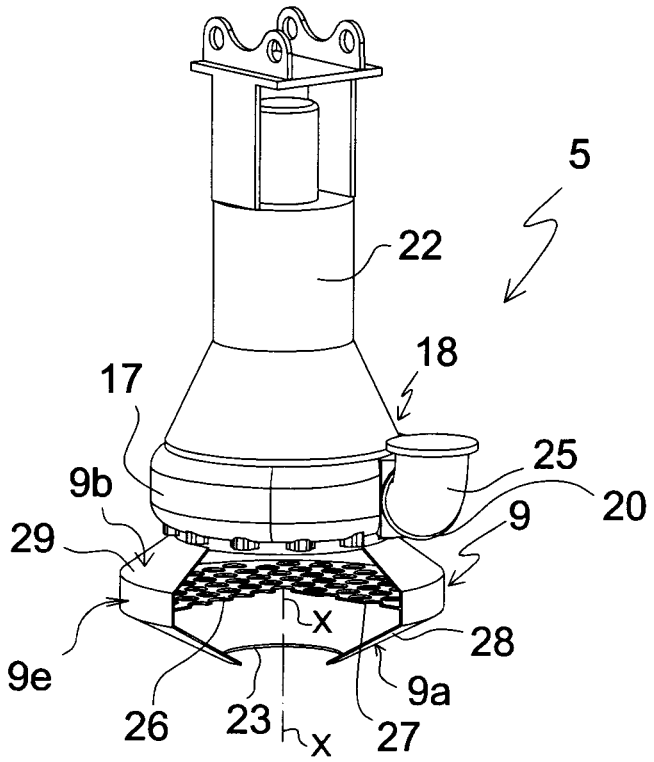

FIG. 9 illustrates a further preferred embodiment of the suction apparatus 5 and of the suction head 9 in the case in which the dredging apparatus 1 lacks the recirculation system 10 of the water to the head 9.

In this case, the suction head 9 is integrally formed as a single piece with the perforated partition 26 and its intermediate portion 9*e* interposed between the portions 9*a* and 9*b* has a substantially constant cross-section area.

The portions 9*a* and 9*b* of the suction head 9, respectively proximal and distal with respect to the suction opening 23 have also in this case a frustoconical shape, thereby obtaining the advantageous technical effects described above in relation to the presence of this specific feature.

In this case, the perforated partition 26 is supported in the suction head 9 at the intermediate portion 9*e* having a substantially constant cross section so as to achieve the advantageous technical effects illustrated above with reference to the embodiment of FIGS. 1-5.

Figure 10:
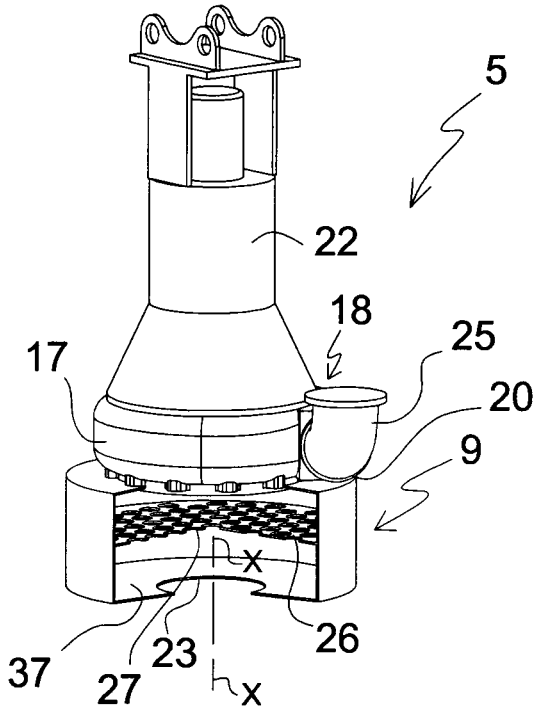

FIG. 10 illustrates a further preferred embodiment of the suction apparatus 5 and of the suction head 9 in the case in which the dredging apparatus 1 lacks the recirculation system 10 of the water to the head 9.

In this case, the suction head 9 is integrally formed as a single piece with the perforated partition 26 and comprises a single cylinder-shaped portion having a substantially constant cross-section area.

In this case, the suction opening 23 is centrally formed in a bottom wall 37 of the head 9 and similarly to the other preferred embodiments illustrated, it has a smaller cross-section area than the maximum cross-section area of the suction head 9 (in this case equal to the area of its cross section that is constant).

Figure 11:
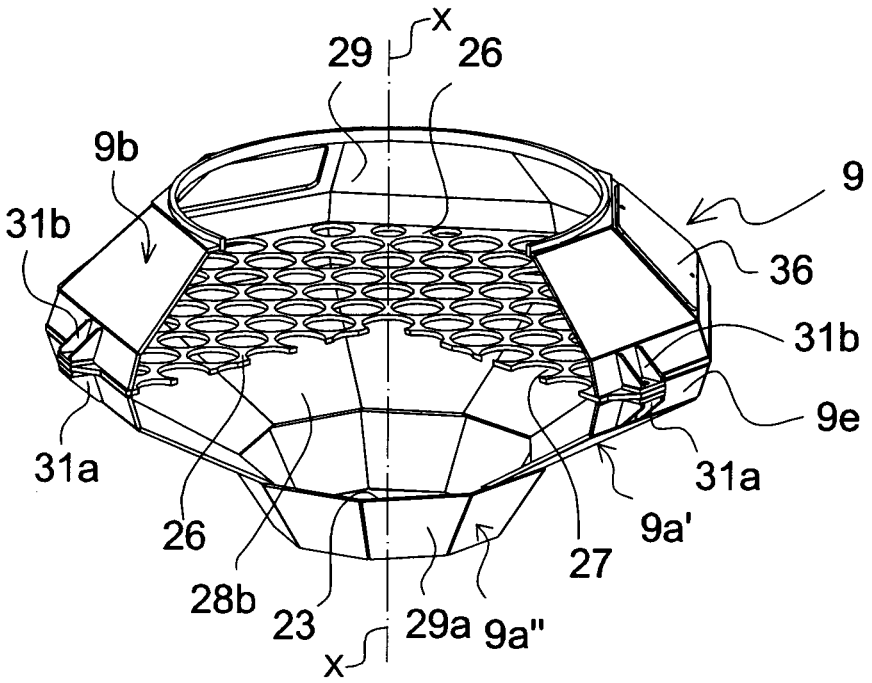
FIGS. 11 and 12 are as many schematic axonometric views partially in cross section and in enlarged scale of suction heads of respective suction apparatuses of further preferred embodiments of the dredging apparatus according to the invention.

FIG. 11 illustrates a further preferred embodiment of the suction apparatus 5 and of the suction head 9 in the case in which the dredging apparatus 1 lacks the recirculation system 10 of the water to the head 9.

In this case and similarly to the preferred embodiment illustrated in FIGS. 1-5, the portion 9*a* proximal to the suction opening 23 and the second portion 9*b* distal with respect to such an opening are structurally independent and are removably associated to one another in an analogous manner by means of a plurality of bolts (not shown).

Also in this case, the perforated partition 26 is removably mounted between the portions 9*a* and 9*b* of the suction head 9 at the intermediate portion 9*e* and the walls of the head 9 are faceted and comprise a plurality of planar segments inclined with respect to the longitudinal axis X-X of the suction opening 23 and connected side-by-side to each other.

In this way, a polygonal suction opening 23 is thus defined also in this case.

In this case, the portion 9*a* proximal to the suction opening 23 differs from the previous ones in that it consists of a pair of portions 9*a*', 9*a*" proximal to the suction opening 23 and having a progressively increasing cross-section area moving away from said opening and a different inclination with respect to the longitudinal axis X-X of the suction opening 23.

More specifically, a first portion 28*a* of the lower wall 28 closest to the suction opening 23 has an inclination with respect to the longitudinal axis X-X comprised between 0° and 85° and, still more preferably, between 5° and 70° and a second portion 28*b* of the lower wall 28 has an inclination with respect to such a longitudinal axis X-X comprised between 5° and 85° and, still more preferably, between 25° and 70°.

In this way, it is advantageously possible to provide the suction head 9 with an element for reducing its cross section which, in the case of particularly cohesive sediments (e.g. compact clay), allows to achieve a cross-section area of the suction opening 23 that is adequately reduced so as to increase the suction speed and therefore the sediment removal capacity of the head 9.

Figure 12:
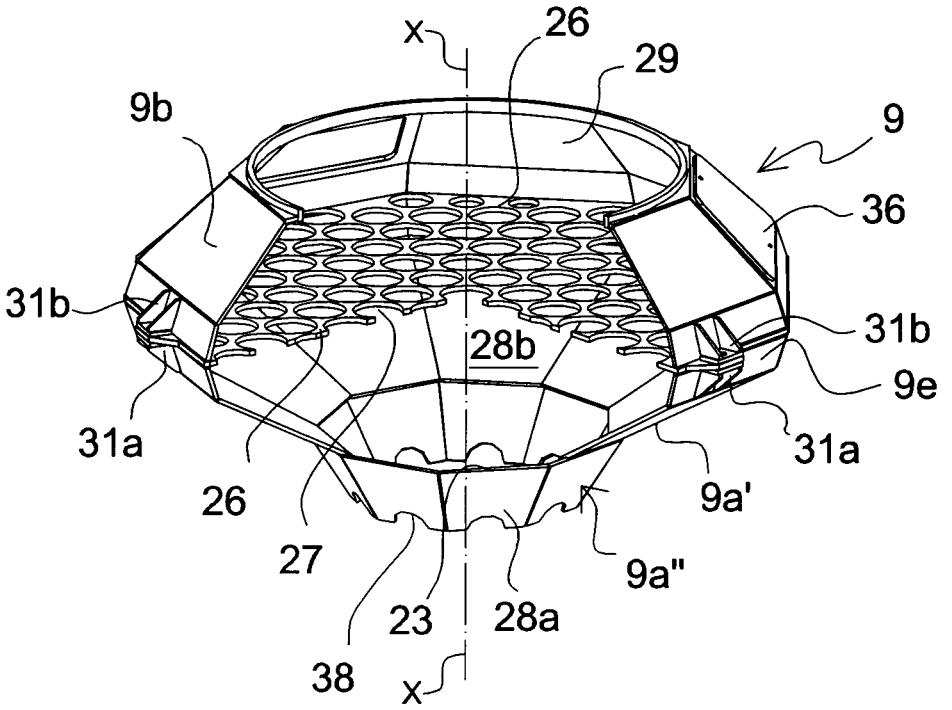

In the embodiment of FIG. 12, the suction head 9 is entirely similar to the head of FIG. 11 with the difference that the reducing element—consisting of the portion 9*a*' closest to the suction opening 23—comprises a plurality of cut outs 38 formed at the peripheral edge of the suction opening 23 so as to avoid the triggering of possible cavitation phenomena in the case of accidental contact with the bed F.

Figure 13:
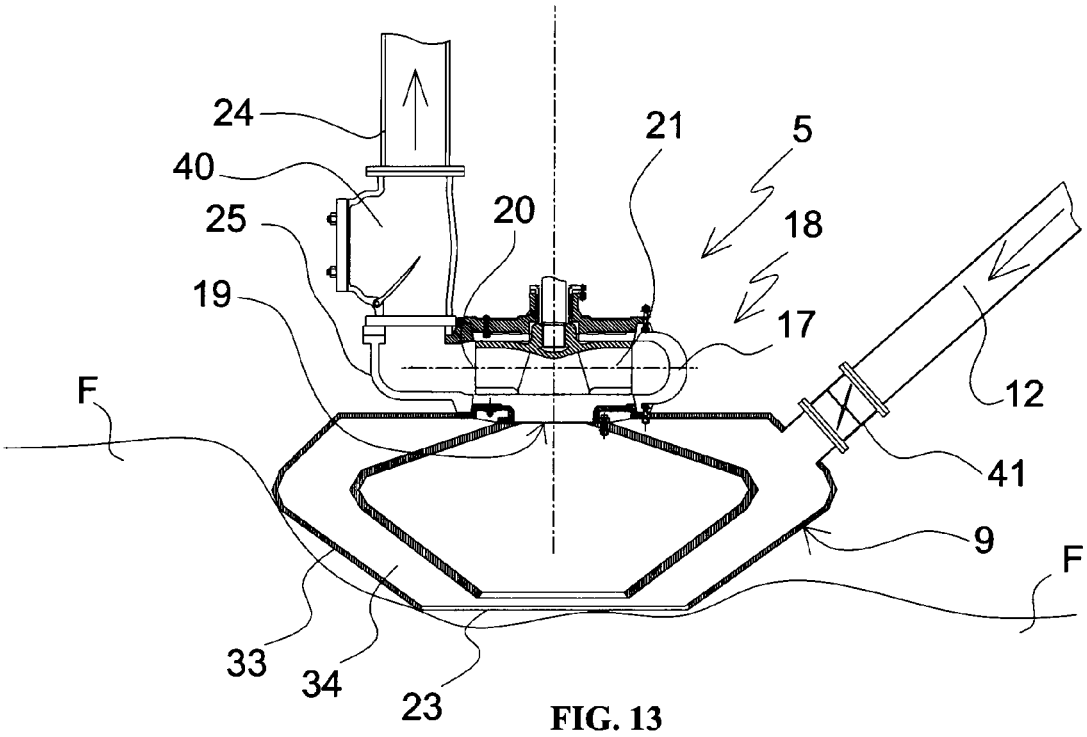
FIG. 13 is a schematic view that illustrates some details of an alternative preferred embodiment of the suction apparatus of the dredging apparatus according to the invention in an operating condition thereof.

Finally, FIG. 13 illustrates a further preferred embodiment of the suction apparatus 5 and of the suction head 9 in the case in which the dredging apparatus 1 is provided with the recirculation system 10 of the water to the head 9 in a similar manner with respect to the previous embodiment of FIGS. 1-5.

In this case, the dredging apparatus 1 comprises a first shut-off valve 40, for example a check valve of the swing type, mounted on the discharge duct 24 of the slurry of water and sediments sucked by the suction head 9 and extending downstream of the discharge opening 20 of the housing body 17 of the submersible pump 18.

Preferably, the dredging apparatus 1 also comprises a second shut-off valve 41, for example a throttle valve, mounted on the recirculation duct 12 of the liquid phase separated by the separating device 8 to the suction opening 23 of the suction head 9.

The presence of the shut-off valves 40, 41 is extremely advantageous in the case in which polluted sites are dredged, since it allows to:

- keeping the recirculated water in a substantially closed circuit, avoiding any type of reintroduction into the environment of pollutants present in the liquid phase, in case of failure of the submersible pump 18 or of other elements of the recirculation system or when the dredging operations are stopped; and
- preventing undesired back-flows of the slurry of water/sediments discharged by the impeller 21 of the submersible pump 18 in case of failure of the latter or when the dredging operations are stopped.

From what has been outlined above, it is thus clear that the dredging apparatus and method of the invention achieve various advantageous technical effects and, more specifically:

- possibility of carrying out the dredging operations without any appreciable dispersion of the sediments which are eroded solely by means of the fluid dynamics removal action carried out by the water sucked into the head;
- possibility of carrying out the dredging operations without contact with the water bed by means of a fluid-dynamic suction/removal action of the sediments carried out by the water sucked by the suction head by means of the depression which is generated close to, in particular beneath and around, the suction opening of the head;

possibility of sucking a water/sediment slurry having a high content of solids, up to a value equal to or greater than 40% by volume and, therefore, with the possibility of obtaining a high dredging efficiency in terms of hourly productivity;

possibility of drastically reducing the environmental impact, so that the dredging apparatus and method may be used in SCI or SNI sites or in any case in areas where for environmental reasons it is not permitted to have any type of water turbidity and/or dispersion of polluting sediments in the water;

possibility of recovering and, if needed, treating and/or exploiting, the dredged solid materials;

possibility of reducing the times and costs of the interventions.

Clearly, a man skilled in the art may introduce modifications and variants to the invention described hereinbefore in order to meet specific and contingent application requirements, variants and modifications which anyway fall within the scope of protection as defined in the attached claims.

The invention claimed is:

1. Dredging apparatus configured to remove sediments from a bed of an expanse of water in absence of any contact with the bed, comprising a suction apparatus including:

a) a submersible pump including:

a1) a housing body provided with an inlet mouth and with a discharge opening;

a2) an impeller rotatably supported in said body between said inlet mouth and said discharge opening and rotatably driven by a driving device;

b) a suction head associated to said inlet mouth of the housing body of the pump and provided at the bottom with a suction opening of the sediments;

wherein the suction opening of the head has a value of the cross-section area dimensioned to achieve in a working range of the pump a suction speed capable of removing the sediments by means of the fluid dynamics removal action carried out by the water sucked into said head;

wherein the dredging apparatus further comprises a separating device for separating a slurry of water and sediments discharged from the suction apparatus in a liquid phase and a solid phase including the sediments and a recirculation system to the suction head of at least a part of the liquid phase separated by said separating device; and wherein the suction head is provided with an inner hollow space defining a radially outer annular portion of the suction opening, said radially outer annular portion of the suction opening being in liquid communication with the recirculation system and being configured to feed the liquid phase separated by the separating device towards the suction opening and inside the suction head.

2. Dredging apparatus according to claim 1, wherein the suction opening of the head has a cross-section area smaller than the maximum cross-section area of the suction head.

3. Dredging apparatus according to claim 1, wherein the suction head comprises at least a first portion proximal to the suction opening having a progressively increasing cross-section area moving away from said opening and a second portion distal with respect to the suction opening having a substantially constant cross-section area.

4. Dredging apparatus according to claim 1, wherein the suction head comprises at least a first portion proximal to the suction opening having a progressively increasing cross-section area moving away from said opening and a second portion distal with respect to the suction opening having a progressively decreasing cross-section area moving away from said first portion.

5. Dredging apparatus according to claim 3, wherein the suction head comprises a pair of portions proximal to the suction opening having a progressively increasing cross-section area moving away from said opening and a different inclination with respect to a longitudinal axis of the suction opening.

6. Dredging apparatus according to claim 4, wherein the suction head further comprises an intermediate portion interposed between said first and second portion of the suction head.

7. Dredging apparatus according to claim 6, wherein said intermediate portion has a substantially constant cross-section area.

8. Dredging apparatus according to claim 6, wherein said intermediate portion comprises a lower portion proximal to the suction opening and having a progressively increasing cross-section area moving away from said opening and an upper portion distal with respect to the suction opening and having a progressively decreasing cross-section area moving away from said lower portion.

9. Dredging apparatus according to claim 6, wherein said first and/or second portion and/or intermediate portion of the suction head has a substantially frusto-conical shape.

10. Dredging apparatus according to claim 6, wherein the suction head comprises a perforated partition supported in said head downstream of said suction opening.

11. Dredging apparatus according to claim 10, wherein said perforated partition is supported in the suction head at said intermediate portion.

12. Dredging apparatus according to claim 1, comprising a plurality of flow deflecting elements associated to the suction head close to said suction opening.

13. Dredging apparatus according to claim 12, wherein said flow deflecting elements comprise a plurality of fins having a substantially rectilinear or curvilinear shape extending along a radial direction or along an inclined direction with respect to said radial direction.

14. Dredging apparatus according to claim 4, wherein said first portion of the suction head is provided with a jacket forming a double wall wherein said inner hollow space is defined.

15. Dredging apparatus according to claim 1, further comprising a plurality of flow deflecting elements arranged in said hollow space close to said suction opening.

16. Dredging apparatus according to claim 15, wherein said flow deflecting elements comprise a plurality of fins having a substantially rectilinear or curvilinear shape extending along a radial direction or along an inclined direction with respect to said radial direction.

17. Dredging apparatus according to claim 1, comprising a first shut-off valve mounted on a discharge duct extending downstream of said discharge opening of the housing body of the submersible pump.

18. Dredging apparatus according to claim 1, comprising a second shut-off valve mounted on a recirculation duct of the liquid phase separated by the separating device to the suction opening of the suction head.

19. Dredging apparatus according to claim 1, further comprising a unit for chemically treating the liquid phase separated by said separating device.

* * * * *